US009116496B2

(12) United States Patent
Miyamoto et al.

(10) Patent No.: US 9,116,496 B2
(45) Date of Patent: Aug. 25, 2015

(54) IMAGE FORMING APPARATUS INCLUDING FIXING PORTION

(71) Applicant: KYOCERA Document Solutions Inc., Osaka-shi, Osaka (JP)

(72) Inventors: Kenji Miyamoto, Osaka (JP); Takahiro Honda, Osaka (JP); Mari Kokomoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/226,251

(22) Filed: Mar. 26, 2014

(65) Prior Publication Data

US 2014/0294405 A1 Oct. 2, 2014

(30) Foreign Application Priority Data

Mar. 29, 2013 (JP) ..... 2013-073623

(51) Int. Cl.
*G03G 15/00* (2006.01)

(52) U.S. Cl.
CPC ..... *G03G 15/70* (2013.01); *G03G 2215/00413* (2013.01); *G03G 2215/00552* (2013.01); *G03G 2221/1675* (2013.01)

(58) Field of Classification Search
CPC ..... G03G 2215/00341; G03G 2215/00413; G03G 2215/00548; G03G 2215/00552; G03G 2221/1675; B61J 11/006; B65H 2601/11; B65H 2601/111; B65H 2601/255; B65H 2511/528
USPC ..... 399/20
See application file for complete search history.

(56) References Cited

U.S. PATENT DOCUMENTS

| | | | | |
|---|---|---|---|---|
| 6,347,196 | B1 * | 2/2002 | Kawabata et al. | 399/16 |
| 8,047,539 | B2 * | 11/2011 | Fujita | 271/259 |
| 8,761,647 | B2 * | 6/2014 | Okano | 399/327 |
| 2008/0095546 | A1 * | 4/2008 | Abe | 399/21 |

FOREIGN PATENT DOCUMENTS

| | | | |
|---|---|---|---|
| JP | 2005274764 | A | 10/2005 |
| JP | 2011145456 | A | 7/2011 |

* cited by examiner

*Primary Examiner* — Daniel J Colilla
*Assistant Examiner* — Justin Olamit
(74) *Attorney, Agent, or Firm* — Alleman Hall McCoy Russell & Tuttle LLP

(57) ABSTRACT

An image forming apparatus according to one aspect of the present disclosure includes print engine portion, paper sheet detectors, and control portion. Control portion stop paper sheet conveyance, when detecting occurrence of jam. Control portion determines fixing nip position which is position of the fixing nip portion on fixing stop paper sheet, on basis of outputs of paper sheet detectors. When fixing nip position is located at leading end side half of fixing stop paper sheet in paper sheet conveying direction, control portion rotates fixing motor in reverse direction to convey fixing stop paper sheet to upstream side in paper sheet conveying direction. When fixing nip position is located at rear end side half of fixing stop paper sheet in paper sheet conveying direction, control portion rotates fixing motor in a forward direction to convey fixing stop paper sheet toward a downstream side in paper sheet conveying direction.

5 Claims, 10 Drawing Sheets

IMAGE FORMING APPARATUS INCLUDING FIXING PORTION

INCORPORATION BY REFERENCE

This application is based upon and claims the benefit of priority from the corresponding Japanese Patent Application No. 2013-073623 filed on Mar. 29, 2013, the entire contents of which are incorporated herein by reference.

BACKGROUND

The present disclosure relates to an image forming apparatus which heats and pressurizes a toner image to fix the toner image on a paper sheet.

In an image forming apparatus such as a printer, jam of a paper sheet may occur. When occurrence of jam is detected, a printing operation such as paper sheet conveyance is stopped in order to avoid worsening of the jam. However, at the stop of the paper sheet conveyance, if a paper sheet which carries a toner image stops at a fixing portion, the quality of an image formed later may be reduced, or melted toner may be attached to a component of the fixing portion. Thus, there is an image forming apparatus in which when paper sheet conveyance is stopped due to occurrence of jam, a paper sheet is conveyed until passing through a fixing portion, in order to prevent the paper sheet from stopping at the fixing portion.

For example, an image forming apparatus is known which includes: a first fixing portion which fixes a toner image at a first nip region; a second fixing portion which performs fixing on a recording material, on which the fixing has been performed by the first fixing portion, at a second nip region again; a recording material detection portion which determines whether the recording material contacts with the first nip region or the second nip region; a conveyance abnormality detection portion which detects whether abnormality of conveyance of the recording material occurs at the downstream side in a recording material conveying direction as seen from the position of the second fixing portion; and a conveyance control portion which causes the recording material to be conveyed toward the downstream side in the recording material conveying direction and stopped at a position at which the recording material does not contact with the first nip region and the second nip region, when the conveyance abnormality detection portion detects occurrence of conveyance abnormality and the recording material contacts with the first nip region or the second nip region. The image forming apparatus attempts to avoid deterioration of image quality which is caused due to offset or the like at occurrence of conveyance abnormality.

When paper sheet conveyance is continued in a state where a paper sheet is jammed, it may be difficult to remove the paper sheet due to the paper sheet being jammed in a compressed manner, etc. In addition, when a severely jammed paper sheet is forcibly removed, a component within the apparatus may be broken, or it may be difficult to remove a part of the paper sheet due to the paper sheet being torn, whereby much time and labor are taken to handle the jam. Thus, in the image forming apparatus, when occurrence of jam is detected, paper sheet conveyance is stopped.

Here, at the fixing portion which fixes a toner image on a paper sheet, the paper sheet is passed through a nip formed between a heating rotator and a pressure rotator. To pressurize the paper sheet, the pressure rotator is pressed against the heating rotator. Thus, when paper sheet conveyance is stopped due to occurrence of jam, it is difficult to pull out and remove a paper sheet caught by the nip of the fixing portion.

Therefore, as in the image forming apparatus, when paper sheet conveyance is stopped due to occurrence of jam, a paper sheet may be conveyed such that the paper sheet does not remain at the fixing portion.

However, in the image forming apparatus, when jam has occurred, even though other paper sheet is present at the downstream side of a paper sheet that is passing through the fixing portion, the paper sheet is conveyed from the fixing portion toward the downstream side. Thus, the paper sheet discharged from the fixing portion may collide against the other paper sheet at the downstream side which has been stopped due to the occurrence of jam. In addition, the other paper sheet that has been stopped due to the occurrence of jam and is present at the downstream side of the fixing portion becomes an obstacle, and thus a paper sheet that is passing through the fixing portion at the occurrence of jam may not be completely discharged from the fixing portion. Moreover, when the paper sheets collide against each other, it may be difficult to remove the paper sheets from a sheet conveyance path, or the paper sheets may be bent.

As described above, in the image forming apparatus, when paper sheet conveyance is stopped due to occurrence of jam, conveyance of a paper sheet from the fixing portion may be stopped after the paper sheet is discharged from the nip of the fixing portion. However, when jam has occurred, since a paper sheet is conveyed to the downstream side in a paper sheet conveying direction without consideration of the distance between sheets in order to pass the paper sheet through the fixing portion, an adverse effect may occur such as collision of the paper sheet against a preceding paper sheet or difficulty in removing the paper sheet from the sheet conveyance path.

The image forming apparatus includes the two fixing portions. When jam has occurred at a cutting portion located at a downstream end in the paper sheet conveyance direction, a paper sheet is conveyed toward the downstream side such that the paper sheet does not contact with each fixing portion. However, in order to prevent collision of paper sheets, the size of each paper sheet needs to be limited to a small size. In addition, in order to support large-sized paper sheets, the intervals among the first fixing portion, the second fixing portion, and the cutting portion need to be sufficiently large, and thus there is the demerit that the image forming apparatus is considerably increased in size.

SUMMARY

An image forming apparatus according to one aspect of the present disclosure includes a print engine portion, paper sheet detectors, and a control portion. The print engine portion is a portion configured to perform printing. The print engine portion includes: a conveying portion configured to convey a paper sheet within the apparatus; an image forming portion configured to form a toner image; a transfer portion configured to transfer the formed toner image onto the paper sheet; and a fixing portion including a heating rotator heated by a heater and a pressure rotator pressed against the heating rotator, the fixing portion being configured to cause the paper sheet to pass through a fixing nip portion which is a nip between the heating rotator and the pressure rotator, to fix the toner image on the paper sheet. A plurality of the paper sheet detectors are provided in the conveying portion. The control portion is configured to control the print engine portion, to detect occurrence of jam on the basis of outputs of the paper sheet detectors, and to cause the print engine portion to perform jam stop of stopping paper sheet conveyance, when detecting occurrence of jam. The control portion determines a fixing nip position which is a position of the fixing nip portion on a fixing stop paper sheet that is a paper sheet nipped at the fixing nip portion at the jam stop, on the basis of the outputs of the paper sheet detectors. When the fixing nip position is located at a leading end side half of the fixing stop paper sheet in a paper sheet conveying direction, the control portion rotates a fixing motor in a reverse direction to convey the fixing stop paper sheet to an upstream side in the paper sheet conveying direction such that the fixing stop paper sheet is separated from the fixing nip portion. When the fixing nip position is located at a rear end side half of the fixing stop paper sheet in the paper sheet conveying direction, the control portion rotates the fixing motor in a forward direction to convey the fixing stop paper sheet toward a downstream side in the paper sheet conveying direction such that the fixing stop paper sheet is separated from the fixing nip portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, a first embodiment and a second embodiment of the present disclosure will be described with reference to FIGS. 1 to 10. First, the first embodiment will be described with reference to FIGS. 1 to 8. Then, the second embodiment will be described with reference to FIGS. 9A to 10. Hereinafter, a printer 100 (corresponding to an image forming apparatus) will be described as an example. It should be noted that elements such as configurations, arrangements, and the like described in each embodiment are not intended to limit the scope of the present disclosure and are merely illustrative.

(Outline of Image Forming Apparatus)

Figure 1:
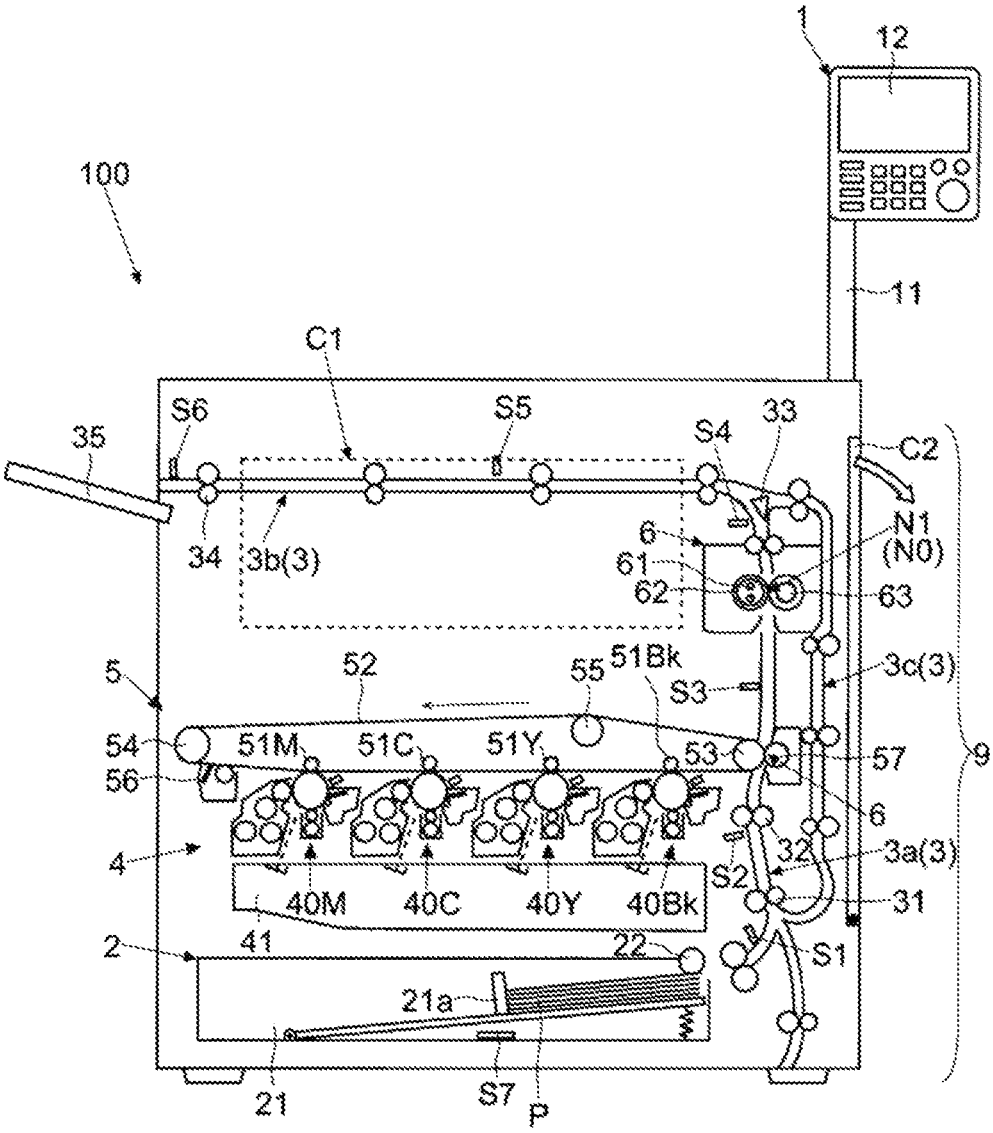
FIG. 1 is a diagram showing the structure of a printer according to a first embodiment of the present disclosure.
Figure 2:
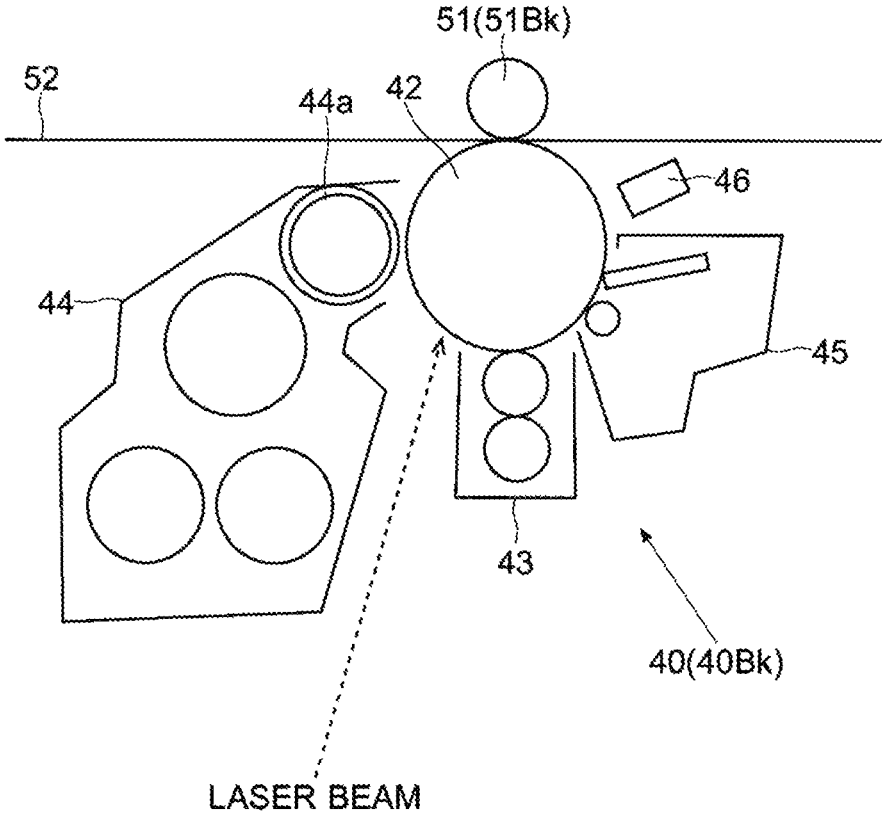
FIG. 2 is a diagram showing an image forming unit according to the first embodiment of the present disclosure.

First, an outline of the printer 100 according to the first embodiment will be described with reference to FIGS. 1 and 2. FIG. 1 is a diagram showing the structure of the printer 100 according to the first embodiment of the present disclosure. FIG. 2 is a diagram showing an image forming unit 40Bk according to the first embodiment of the present disclosure.

As shown in FIG. 1, the printer 100 according to the present embodiment includes an operation panel 1 (corresponding to a notification portion) mounted laterally thereto. In addition, the printer 100 includes therein a sheet feed portion 2, a first conveying portion 3*a* (corresponding to a conveying portion), an image forming portion 4, an intermediate transfer portion 5, a fixing portion 6, and a second conveying portion 3*b* (corresponding to the conveying portion).

As shown in FIG. 1, the operation panel 1 is provided at an end of an arm 11 provided at a right side of an upper portion of the printer 100. The operation panel 1 includes a display portion 12 which displays a state of the printer 100, various messages, and a screen for setting. The display portion 12 includes a touch panel and a liquid crystal panel. The display portion 12 gives notice of a state of the printer 100 such as an error message by means of displaying. In addition, the display portion 12 receives setting by a user such as printing conditions.

As shown in FIG. 1, the sheet feed portion 2 is disposed in an inner lower portion of the printer 100. The sheet feed portion 2 includes a cassette 21. The cassette 21 stores paper sheets P. The sheet feed portion 2 is provided with a sheet feed roller 22 which is rotated by driving of a sheet feed motor 2*m* (see FIG. 4) to convey the paper sheet P stored in the cassette 21, from the cassette 21. The sheet feed roller 22 feeds the paper sheet P to the first conveying portion 3*a*.

The first conveying portion 3*a* guides the paper sheet P supplied from the sheet feed portion 2, to the fixing portion 6. The first conveying portion 3*a* is provided with a conveying roller pair 31, a registration roller pair 32, and the like. The registration roller pair 32 causes the paper sheet P conveyed thereto to stand by just before a secondary transfer roller 57 (an intermediate transfer belt 52) and feeds the paper sheet P at a timing of secondary transferring of a toner image onto the paper sheet P.

The image forming portion 4 forms a toner image on the basis of image data of an image to be formed. The image forming portion 4 includes image forming units 40 (40Bk, 40Y, 40C, and 40M) for four colors and an exposure device 41. Specifically, the image forming portion 4 includes an image forming unit 40Bk which forms a black image, an image forming unit 40Y which forms an yellow image, an image forming unit 40C which forms a cyan image, and an image forming unit 40M which forms a magenta image.

The respective image forming units 40Bk to 40M will be described in detail with reference to FIG. 2. It should be noted that the respective image forming units 40Bk to 40M basically have the same configuration, although the colors of toner images formed by the image forming units 40Bk to 40M are different from each other. Thus, hereinafter, the image forming unit 40Bk will be described as an example. In the following description, the reference signs Bk, Y, C, and M indicating the colors are omitted except in the case where a description is particularly needed.

First, the image forming unit 40 includes a photosensitive drum 42, a charging device 43, a developing device 44, and a drum cleaning device 45. The photosensitive drum 42 is rotatably supported. The photosensitive drum 42 is rotationally driven at a predetermined circumferential speed by a driving force of a main motor 4*m* (see FIG. 4). The photosensitive drum 42 (an image carrier) carries a toner image on the circumferential surface thereof through processes of charging, exposure, and development.

The charging device 43 charges the surface of the photosensitive drum 42 at a predetermined potential. The exposure device 41 includes therein optical components such as a semiconductor laser device (laser diode), a polygon mirror, a polygon motor, an fθ lens, a mirror (not shown), and the like. The exposure device 41 irradiates the charged photosensitive drum 42 with an optical signal (a laser beam, indicated by a dashed line) which is based on an image signal obtained by color separation of image data, by using these optical components to form an electrostatic latent image on the circumferential surface of the photosensitive drum 42.

The developing device 44 stores a developer which contains a carrier composed of a magnetic material and a toner (a so-called two-component developer). The developing device 44 causes the toner to fly toward the photosensitive drum 42 and develops the electrostatic latent image with the toner.

The drum cleaning device 45 cleans the photosensitive drum 42. In addition, a charge removing device 46 which irradiates the photosensitive drum 42 with light to remove electric charge is provided above the drum cleaning device 45.

Referring back to FIG. 1, the description is continued. In order to transfer the toner images formed on the photosensitive drums 42 onto the paper sheet P, the intermediate transfer portion 5 is provided. The intermediate transfer portion 5 receives primary transfer of the toner images from the photosensitive drums 42 and secondarily transfers the toner images onto the paper sheet P.

The intermediate transfer portion 5 includes a plurality of primary transfer rollers 51 (51Bk, 51Y, 51C, and 51M), the intermediate transfer belt 52, a driving roller 53, driven rollers 54 and 55, a belt cleaning device 56, and the secondary transfer roller 57.

The intermediate transfer belt 52 which is an endless belt extends on and between the primary transfer rollers 51Bk to 51M, the driving roller 53, and the driven rollers 54 and 55. The intermediate transfer belt 52 circulates in a counterclockwise direction on the sheet surface of FIG. 1 by the driving roller 53 being rotated by a driving force from an intermediate transfer motor 5*m* (see FIG. 4). In addition, the respective primary transfer rollers 51Bk to 51M and the corresponding photosensitive drums 42 sandwich the endless intermediate transfer belt 52 therebetween. A voltage for performing primary transfer is applied to each of the primary transfer rollers 51Bk to 51M. Toner images (black, yellow, cyan, and magenta) formed by the image forming units 40 are primarily transferred onto the intermediate transfer belt 52 so as to be sequentially superimposed thereon without displacement.

In addition, the driving roller 53 and the secondary transfer roller 57 sandwich the intermediate transfer belt 52 therebetween, and the intermediate transfer belt 52 and the secondary transfer roller 57 form a nip through which the paper sheet P passes. A predetermined voltage is applied to the secondary transfer roller 57. Thus, the toner image on the intermediate transfer belt 52 is secondary transferred onto the paper sheet P. The toner and the like remaining on the intermediate transfer belt 52 are removed and collected by the belt cleaning device 56.

The fixing portion 6 is disposed at the downstream side of the image forming portion 4 in a paper sheet conveying direction. The fixing portion 6 heats and pressurizes the toner image transferred onto the paper sheet P, thereby fixing the toner image thereon. The fixing portion 6 mainly includes a heating roller 62 (corresponding to a heating rotator) which is heated by a heater 61, and a pressure roller 63 (corresponding to a pressure rotator) which is pressed against the heating roller 62. The paper sheet P on which the toner image has been transferred is heated and pressurized when passing through a fixing nip portion N1 between the heating roller 62 and the pressure roller 63. As a result, the toner image is fixed on the paper sheet P. The paper sheet P on which the fixing has been performed is conveyed to the second conveying portion 3*b* provided above the fixing portion 6.

The paper sheet P having passed through the fixing portion 6 is conveyed through the second conveying portion 3*b* which extends from a branch portion 33 toward a left side surface of the printer 100. Then, the paper sheet P is discharged by a discharge roller pair 34 to a discharge tray 35 which is provided at the left side surface of an outer side of an upper portion of the printer 100. Due to this, printing of one page is completed.

It should be noted that in double-sided printing, the paper sheet P that has been printed on one surface thereof and discharged from the fixing portion 6 is once sent from the branch portion 33 in the direction to the discharge tray 35, and is switched back such that the paper sheet conveying direction is reversed to the direction toward a right side surface of the printer 100. Then, the paper sheet P passes through the branch portion 33 and is conveyed downward through a double-sided printing conveying portion 3*c*, and is sent through the first conveying portion 3*a* to the registration roller pair 32 again.

(Hardware Configuration of Printer 100)

Figure 3:
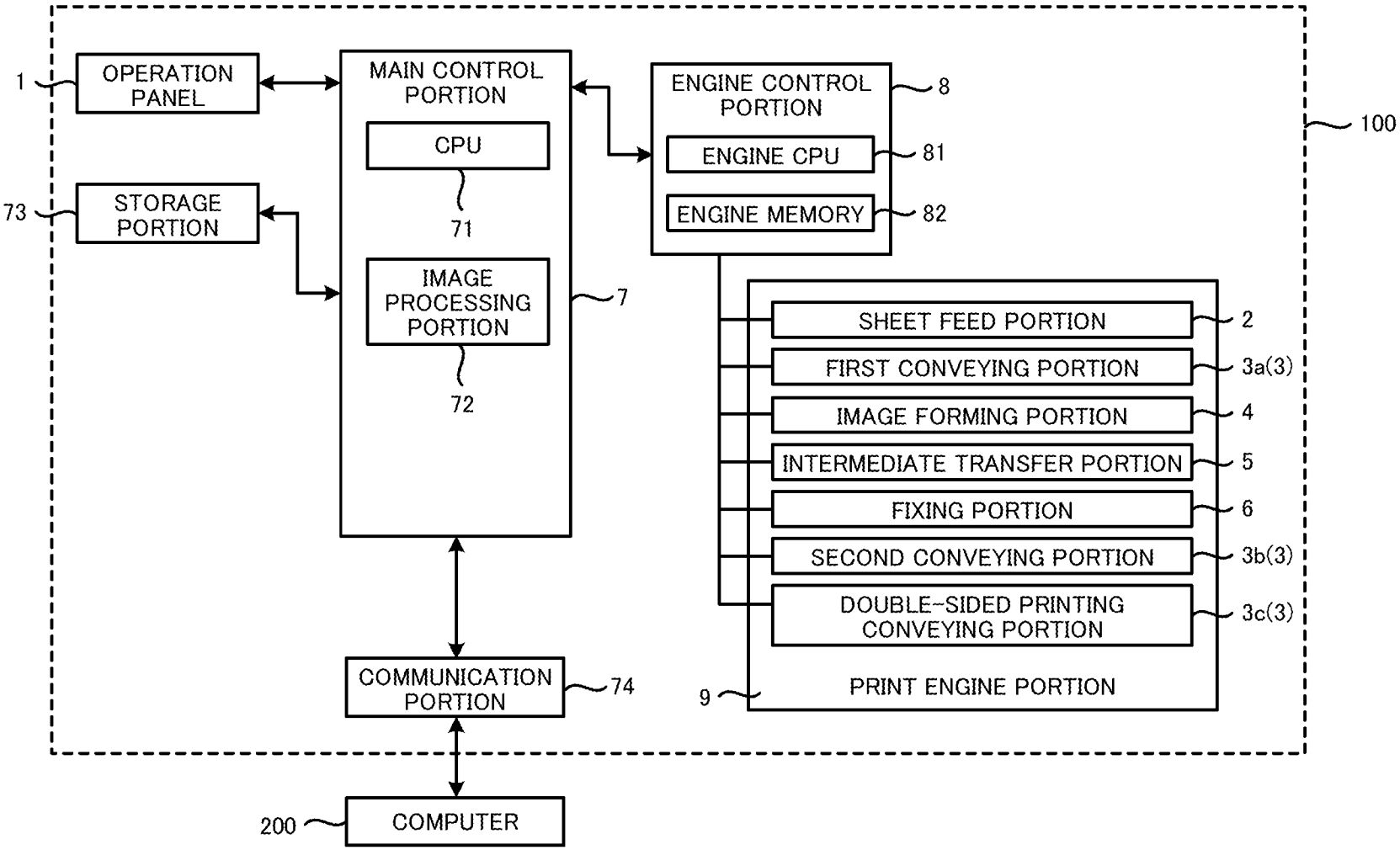
FIG. 3 is a diagram showing the hardware configuration of the printer according to the first embodiment of the present disclosure.

Next, the hardware configuration of the printer 100 according to the first embodiment will be described with reference to FIG. 3. FIG. 3 is a diagram showing the hardware configuration of the printer 100 according to the first embodiment of the present disclosure.

As shown in FIG. 3, the printer 100 includes a main control portion 7 (corresponding to a control portion) therein. The main control portion 7 includes a CPU 71 which performs various arithmetic processing and signal processing, an image processing portion 72 which performs image processing on image data, and the like. The main control portion 7 causes the CPU 71 and the image processing portion 72 to perform various processing to control each portion of the printer 100.

The CPU 71 is a central processing unit, and performs various calculations and control of each portion of the printer 100 on the basis of various data, such as control data and setting data, and a control program which are stored in a storage portion 73. The storage portion 73 is composed of a combination of non-volatile storage units such as a ROM, a flash ROM, and an HDD, and a volatile storage unit such as a RAM. The storage portion 73 stores the control program, the control data, and the like of the printer 100.

In addition, the main control portion 7 is connected to the operation panel 1 and recognizes setting made with respect to the operation panel 1. Moreover, the main control portion 7 causes the display portion 12 to display information indicating a state of the printer 100, such as occurrence of an error or abnormality.

In addition, the main control portion 7 is connected to a communication portion 74. The communication portion 74 is a communication interface for communicating via a network, a cable, or a public line with a computer 200 which is a transmission source of printing data including image data indicating a content to be printed or setting data in printing. The communication portion 74 receives print data from the computer 200.

The image processing portion 72 performs various image processing such as expansion, reduction, rotation, density conversion, and data form conversion in accordance with setting on image data received from the computer 200. Then, at execution of a printing job, the image processing portion 72 sends image data on which image processing has been performed, to the exposure device 41. The exposure device 41 performs scanning and exposure of the photosensitive drum 42 upon reception of the image data.

The printer 100 includes therein a print engine portion 9 which includes the sheet feed portion 2, the first conveying portion 3*a*, the image forming portion 4, the intermediate transfer portion 5, the fixing portion 6, the second conveying portion 3*b*, and the double-sided printing conveying portion 3*c* and which conveys the paper sheet P and forms a toner image to perform printing. The printer 100 also includes therein an engine control portion 8 (corresponding to the control portion) which controls an operation of the print engine portion 9. The main control portion 7 and the engine control portion 8 are connected to each other in a communicable manner. When printing is performed, the main control portion 7 provides an instruction to execute the printing and data indicating printing contents, such as the number of pages and functions to be used, to the engine control portion 8 to cause the printing to be performed. It should be noted that the main control portion 7 may control the print engine portion 9.

The engine control portion 8 includes an engine CPU 81 which performs calculations and processing regarding printing. In addition, the engine control portion 8 includes an engine memory 82 which stores data and a program regarding an operation of the print engine portion 9. The engine control portion 8 actually controls an operation of the print engine portion 9 on the basis of an instruction from the main control portion 7 to cause the print engine portion 9 to perform printing.

(Paper Sheet Conveyance)

Figure 4:
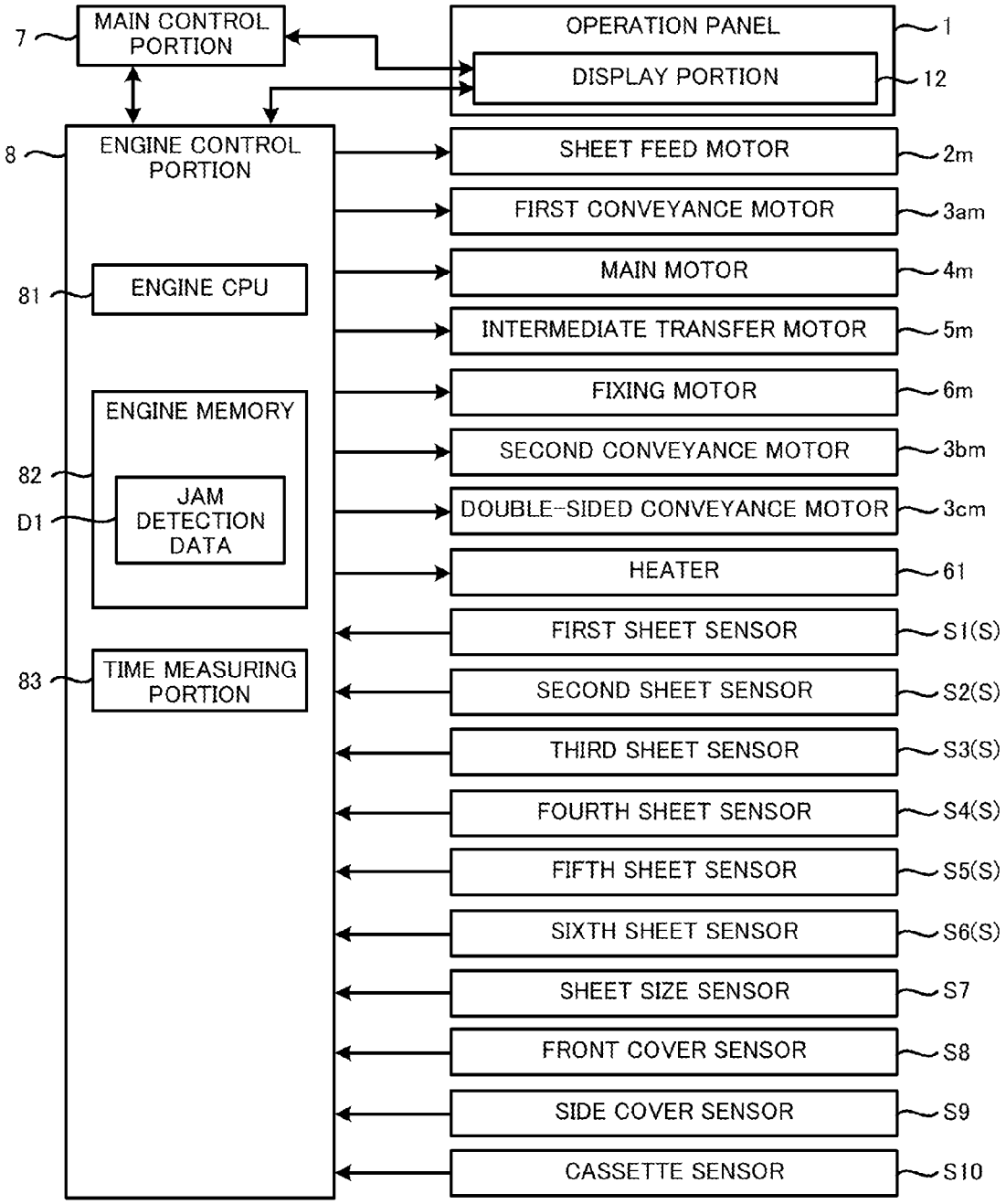
FIG. 4 is a diagram for explaining paper sheet conveyance according to the first embodiment of the present disclosure.

Next, conveyance of the paper sheet P will be described with reference to FIGS. 1 and 4. FIG. 4 is a diagram for explaining paper sheet conveyance according to the first embodiment of the present disclosure.

The printer 100 according to the first embodiment includes the sheet feed motor 2*m*, a first conveyance motor 3*am*, the main motor 4*m*, the intermediate transfer motor 5*m*, a fixing motor 6*m*, a second conveyance motor 3*bm*, a double-sided conveyance motor 3*cm* as motors which rotate rotators regarding conveyance of the paper sheet P and toner image formation.

The engine control portion 8 can rotate the sheet feed motor 2*m* to rotate the sheet feed roller 22, thereby causing the sheet feed portion 2 to feed and convey the paper sheet P. In addition, the engine control portion 8 can rotate the first conveyance motor 3*am* to rotate the conveying roller pair 31 and the registration roller pair 32, thereby causing the first conveying portion 3*a* to convey the paper sheet P. It should be noted that an electromagnetic clutch (not shown) is provided on a drive transmission path to the registration roller pair 32, and the engine control portion 8 can control the electromagnetic clutch to control rotation and stop of the registration roller pair 32.

In addition, the engine control portion 8 can rotate the intermediate transfer motor 5*m* to rotate the driving roller 53 to circulate the intermediate transfer belt 52, thereby causing the intermediate transfer portion 5 and the secondary transfer roller 57 to move a toner image and convey the paper sheet P. Moreover, the engine control portion 8 can rotate the main motor 4*m*, which rotates the photosensitive drum 42, to rotate the photosensitive drum 42 in accordance with the circulation of the intermediate transfer belt 52.

In addition, the engine control portion 8 can rotate the fixing motor 6*m* to rotate the heating roller 62 and the pressure roller 63, thereby causing the fixing portion 6 to convey the paper sheet P. The fixing motor 6*m* is a motor which is rotatable in a forward direction (a direction in which the paper sheet P is conveyed toward the downstream side) and also in a reverse direction.

In addition, the engine control portion 8 can rotate the second conveyance motor 3*bm* to rotate rollers for conveyance within the second conveying portion 3*b* such as the discharge roller pair 34, thereby causing the second conveying portion 3*b* to convey the paper sheet P. Moreover, the engine control portion 8 can rotate the double-sided conveyance motor 3*cm* to rotate rollers for conveyance within the double-sided printing conveying portion 3*c*, thereby causing the second conveying portion 3*b* to convey the paper sheet P.

As described above, the engine control portion 8 controls rotation of each motor to cause each portion within the printer 100 to convey the paper sheet P. Specifically, the engine control portion 8 controls each motor to cause the sheet feed portion 2, the first conveying portion 3*a*, the intermediate transfer portion 5, the secondary transfer roller 57, the fixing portion 6, the second conveying portion 3*b*, and the double-sided printing conveying portion 3*c* of the print engine portion 9 to convey the paper sheet P.

(Recognition of Paper Sheet Position and Detection of Occurrence of Jam)

Next, recognition of a paper sheet position and detection of jam will be described with reference to FIGS. 1 and 4.

First, paper sheet sensors S for recognizing a paper sheet position and detecting jam will be described. Hereinafter, the first conveying portion 3*a*, the second conveying portion 3*b*, and the double-sided printing conveying portion 3*c* are sometimes collectively referred to as a "paper sheet conveying portion 3".

As shown in FIGS. 1 and 4, in the printer 100 according to the present embodiment, a plurality of paper sheet sensors S (corresponding to paper sheet detectors) are provided along a conveyance path of the paper sheet P. Each paper sheet sensor S is a sensor which changes its output when detecting presence of the paper sheet P and when not detecting presence of the paper sheet P. An optical sensor may be used as each paper sheet sensor S.

As shown in FIGS. 1 and 4, a first paper sheet sensor S1, a second paper sheet sensor S2, a third paper sheet sensor S3, a fourth paper sheet sensor S4, a fifth paper sheet sensor S5, and a sixth paper sheet sensor S6 are provided as the paper sheet sensors S in order from the upstream side in the paper sheet conveying direction. In addition, one or a plurality of paper sheet sensors S may be further provided, for example, in the double-sided printing conveying portion 3*c* or the like.

The first paper sheet sensor S1 is provided between the sheet feed roller 22 of the sheet feed portion 2 and a merging portion of a paper feed path from the sheet feed portion 2 to the first conveying portion 3*a*. The first paper sheet sensor S1 is a sensor for detecting whether the paper sheet P has been appropriately fed from the sheet feed portion 2 to the first conveying portion 3*a*.

The second paper sheet sensor S2 is provided in the first conveying portion 3*a* and between the conveying roller pair 31 and the registration roller pair 32. The second paper sheet sensor S2 is a sensor for detecting whether the paper sheet P has reached the registration roller pair 32 and has passed through the registration roller pair 32.

The third paper sheet sensor S3 is provided in the first conveying portion 3*a* and between the fixing portion 6 and a portion of the intermediate transfer belt 52 which is sandwiched between the secondary transfer roller 57 and the driving roller 53. The third paper sheet sensor S3 is a sensor for detecting whether the paper sheet P has been conveyed beyond the secondary transfer roller 57 and has passed through the secondary transfer roller 57.

The fourth paper sheet sensor S4 is provided in the first conveying portion 3*a* and between the fixing portion 6 and a position at which the second conveying portion 3*b* and the double-sided printing conveying portion 3*c* branch from the first conveying portion 3*a*. The fourth paper sheet sensor S4 is a sensor for detecting whether the paper sheet P has reached the fixing portion 6 and has passed through the fixing portion 6.

The fifth paper sheet sensor S5 is provided in the second conveying portion 3*b* and between the fixing portion 6 and the discharge roller pair 34. The fifth paper sheet sensor S5 is a sensor for detecting whether the paper sheet P is accurately conveyed toward the discharge roller pair 34.

The sixth paper sheet sensor S6 is provided in the second conveying portion 3*b* and at the downstream side of the discharge roller pair 34 in the paper sheet conveying direction. The sixth paper sheet sensor S6 is a sensor for detecting whether the paper sheet P has reached the discharge roller pair 34 and has been accurately discharged to the discharge tray 35.

As shown in FIG. 4, output of each paper sheet sensor S (the first to sixth paper sheet sensors S1 to S6) is inputted to the engine control portion 8. The engine control portion 8 can recognize whether the paper sheet P is present at the position where each paper sheet sensor S is installed, has reached the position, or has passed through the position, by recognizing the output of each paper sheet sensor S.

Next, recognition of a paper sheet position will be described. First, in the printer 100 according to the present embodiment, at the time when the paper sheet P reaches the registration roller pair 32, the engine control portion 8 stops the registration roller pair 32. Then, in a state where the paper sheet P contacts with the registration roller pair 32, the engine control portion 8 continuously rotates the conveying roller pair 31 to bend the paper sheet P, thereby correcting skewing of the paper sheet P. Thereafter, the engine control portion 8 rotates the registration roller pair 32. In other words, the sheet feed roller 22 performs primary sheet feeding, and the registration roller pair 32 performs secondary sheet feeding. Thus, hereinafter, recognition of a paper sheet position from the sheet feed portion 2 to the registration roller pair 32 and recognition of a paper sheet position at the downstream side of the registration roller pair 32 will be individually described.

(1) Recognition of a Paper Sheet Position from the Sheet Feed Portion 2 to the Registration Roller Pair 32.

First, a paper sheet conveying speed is determined in the printer 100 according to the present embodiment. Thus, the engine control portion 8 can recognize (calculate) the position of a paper sheet leading end by multiplying a time from start of rotation of the sheet feed roller 22 by the paper sheet conveying speed.

In addition, the engine control portion 8 can recognize the position of the leading end of the paper sheet P by detecting reaching of the paper sheet P with the first paper sheet sensor S1 and the second paper sheet sensor S2. Then, the engine control portion 8 can recognize the position of the leading end of the paper sheet P by multiplying a time, which has elapsed from a time when the first paper sheet sensor S1 or the second paper sheet sensor S2 detects that the leading end of the paper sheet P has reached the installation position of the first paper sheet sensor S1 or the second paper sheet sensor S2, by the paper sheet conveying speed to obtain the distance from the installation position of the first paper sheet sensor S1 or the second paper sheet sensor S2 to the leading end of the paper sheet P.

In addition, the engine control portion 8 can recognize, as the position of the rear end of the paper sheet P, a position which goes back from the recognized position of the leading end of the paper sheet P toward the upstream side by the paper sheet size. Moreover, the engine control portion 8 can recognize the position of the rear end of the paper sheet P by multiplying a time, which has elapsed from a time when the first paper sheet sensor S1 or the second paper sheet sensor S2 detects that the rear end has passed through the installation position of the first paper sheet sensor S1 or the second paper sheet sensor S2, by the paper sheet conveying speed to obtain the distance from the installation position of the first paper sheet sensor S1 or the second paper sheet sensor S2 to the rear end of the paper sheet P.

It should be noted that a paper sheet size sensor S7 (see FIG. 4) for detecting the sizes of the paper sheets P within the cassette 21 is provided in the sheet feed portion 2. In the present embodiment, a paper sheet regulation plate 21*a* (see FIG. 1) which regulates rear ends of the paper sheets P within the cassette 21 is slidable in accordance with the sizes of the paper sheets P. The paper sheet size sensor S7 includes a variable resistance whose resistance value changes in response to the position of the paper sheet regulation plate 21*a*, and an output value of the paper sheet size sensor S7 changes in response to the position of the paper sheet regulation plate 21*a*. The engine memory 82 stores data which defines a paper sheet size corresponding to the output value of the paper sheet size sensor S7. The engine control portion 8 detects the size of each paper sheet P in the direction in which the paper sheet P is conveyed, on the basis of the magnitude of the output of the paper sheet size sensor S7 and the data in the engine memory 82. It should be noted that the sizes of the paper sheets within the sheet feed portion 2 may be determined by another method such as by setting a paper sheet size with the operation panel 1.

(2) Recognition of a Paper Sheet Position at the Downstream Side of the Registration Roller Pair 32.

The engine control portion 8 can recognize the position of a paper sheet leading end at the downstream side of the registration roller pair 32 by multiplying a time from start of rotation of the registration roller pair 32 by the predetermined paper sheet conveying speed.

In addition, the engine control portion 8 can recognize that the leading end of the paper sheet P has passed through the installation position of each paper sheet sensor S, by detecting reaching of the paper sheet P with the third to sixth paper sheet sensors S3 to S6. Then, the engine control portion 8 can recognize the position of the leading end of the paper sheet P by multiplying a time, which has elapsed from a time when each paper sheet sensor S (the third to sixth paper sheet sensors S3 to S6) at the downstream side of the registration roller pair 32 detects that the leading end of the paper sheet P has reached the installation position of each paper sheet sensor S, by the paper sheet conveying speed to obtain the distance from the installation position of the paper sheet sensor S that has detected the reaching of the leading end of the paper sheet P to the leading end of the paper sheet P.

In addition, the engine control portion 8 can recognize, as the position of the rear end of the paper sheet P, a position which goes back from the recognized position of the leading end of the paper sheet P toward the upstream side by the paper sheet size. Moreover, the engine control portion 8 can recognize the position of the rear end of the paper sheet P by multiplying a time, which has elapsed from a time when each paper sheet sensor S (the third to sixth paper sheet sensors S3 to S6) detects that the rear end of the paper sheet P has passed through the installation position of each paper sheet sensor S, by the paper sheet conveying speed to obtain the distance from the installation position of each paper sheet sensor S to the rear end of the paper sheet P.

It should be noted that the engine control portion 8 is provided with a time measuring portion 83 for measuring an elapsed time from start of rotation of the sheet feed roller 22, an elapsed time from start of rotation of the registration roller pair 32, and a time from detection of the paper sheet P having reached or having passed through the installation position of each paper sheet sensor S.

In the above example, the position of the leading end or the position of the rear end of the paper sheet P is obtained as a length. These positions are obtained by multiplying a time from start of sheet feeding or detection with the sensor by the predetermined paper sheet conveying speed. Thus, the position of the leading end or the position of the rear end of the paper sheet P may be obtained as a time from start of rotation of the sheet feed roller 22 or the registration roller pair 32, or as a time from reaching of the paper sheet P at the installation position of each paper sheet sensor S or passing of the paper sheet P through the installation position of each paper sheet sensor S.

Next, detection of jam during paper sheet conveyance will be described.

During printing, the engine control portion 8 can recognize occurrence of jam of the paper sheet P by recognizing the output of each paper sheet sensor S. Specifically, the paper sheet conveying speed is previously determined. In addition, the installation position of each paper sheet sensor S is fixed, and the distance from the sheet feed portion 2 to each paper sheet sensor S and the distance between each paper sheet sensor S are determined. Thus, on the basis of the paper sheet conveying speed, the paper sheet size, the distances from the leading ends of the paper sheets P placed in the sheet feed portion 2 to the first paper sheet sensor S1 and the second paper sheet sensor S2, the distance from the registration roller pair 32 to each paper sheet sensor S (the third to sixth paper sheet sensors S3 to S6), and the distance between each sensor, the engine control portion 8 recognizes that jam has occurred, when the control portion 8 has not detected reaching (presence) of the paper sheet P even in a time period in which the reaching of the paper sheet P should be detected, or when the control portion 8 has not detected passing of the paper sheet P and has continuously detected presence of the paper sheet P even in a time period in which the passing of the paper sheet P should be detected. It should be noted that each of the time periods is obtained by providing a margin to an ideal reaching time or passing time of the paper sheet P, and indicates an allowable range of fast progress and delay of conveyance of the paper sheet P.

Jam detection data D1 for the engine control portion 8 to detect occurrence of jam is stored in the engine memory 82. The engine control portion 8 recognizes and detects occurrence of jam on the basis of the data stored in the engine memory 82.

In the jam detection data D1, data is stored which defines, in accordance with the paper sheet size: a time period in which the engine control portion 8 should detect that the paper sheet P has reached the installation position of each paper sheet sensor S (the first to sixth paper sheet sensors S1 to S6); and a time period in which the engine control portion 8 should detect that the paper sheet P has passed through the installation position of each paper sheet sensor S, from start of sheet feeding or start of rotation of the registration roller pair 32. For example, in the jam detection data D1, a time period in which the engine control portion 8 should detect that the paper sheet P has reached or passed through the installation position of the first paper sheet sensor S1 from start of feeding the paper sheet P, and a time period in which the engine control portion 8 should detect that the paper sheet P has reached or passed through the installation position of the third paper sheet sensor S3 from start of rotation of the registration roller pair 32 are determined in accordance with the paper sheet size.

In addition, the engine control portion 8 also can detect occurrence of jam with, as a starting point, a time of detection of the paper sheet P having reached or having passed through the installation position of a certain paper sheet sensor S. In this case, in the jam detection data D1, a time period in which the engine control portion 8 should detect that the paper sheet P has reached or has passed through the installation position of the certain paper sheet sensor S or the installation position of a paper sheet sensor S at the downstream side of the installation position of the certain paper sheet sensor S may be defined with, as a starting point, a predetermined time such as a time of detection of the paper sheet P having reached or having passed through the installation position of the certain paper sheet sensor S. For example, in the jam detection data D1, a time period in which the engine control portion 8 should detect that the paper sheet P has passed through the installation position of the third paper sheet sensor S3, and a time period in which the engine control portion 8 should detect that the paper sheet P has reached or has passed through the installation position of the fourth paper sheet sensor S4, after detection of the paper sheet P having reached the installation position of the third paper sheet sensor S3, are determined.

The engine control portion 8 monitors the output of each paper sheet sensor S (the first to sixth paper sheet sensors S1 to S6). The engine control portion 8 determines that jam has occurred, when there is the paper sheet sensor S at which reaching of the paper sheet P has not been detected in a time period in which the reaching of the paper sheet P should be detected or there is the paper sheet sensor S through which passing of the paper sheet P has not been detected in a time period in which the passing of the paper sheet P should be detected. In other words, the engine control portion 8 detects occurrence of jam.

In addition, the engine control portion 8 can also determine at which position in the paper sheet conveying portion 3 jam has occurred, on the basis of the installation position of the paper sheet sensor S at which reaching of the paper sheet P has not been detected in a time period in which the reaching of the paper sheet P should be detected or the installation position of the paper sheet sensor S through which passing of the paper sheet P has not been detected in a time period in which the passing of the paper sheet P should be detected. When the engine control portion 8 has not detected passing of the paper sheet P even after elapse of a time period in which the passing of the paper sheet P should be detected with a certain paper sheet sensor S, the engine control portion 8 determines that jam has occurred at the installation position of the paper sheet sensor S. Moreover, the engine control portion 8 determines that jam has occurred upstream of the installation position of the paper sheet sensor S at which reaching of the paper sheet P has not been detected even after elapse of a time period in which the reaching of the paper sheet P should be detected.

(Flow of Detection of Occurrence of Jam)

Figure 5:
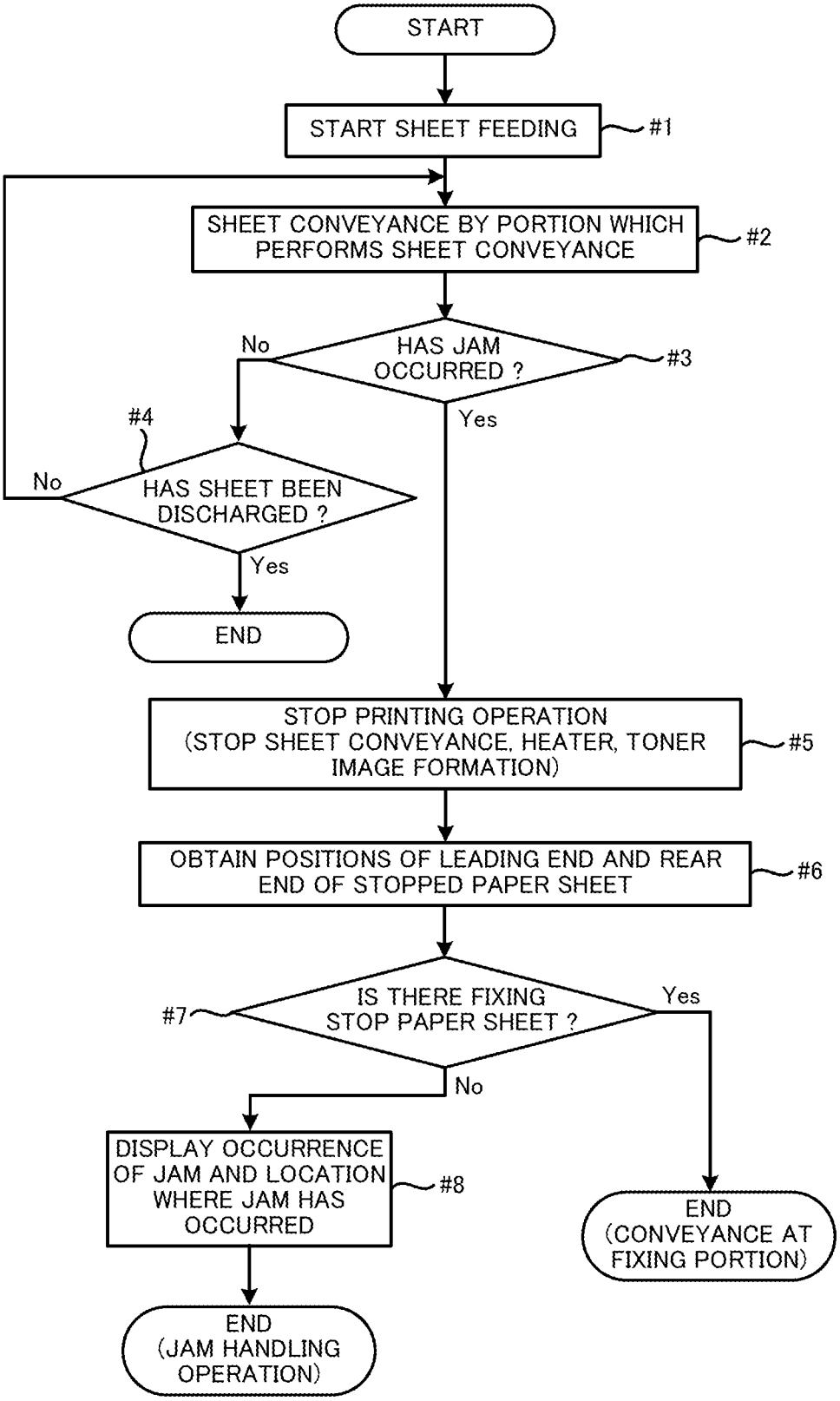
FIG. 5 is a flowchart showing an example of flow of detection of occurrence of jam according to the first embodiment of the present disclosure.

Next, flow of detection of occurrence of jam will be described with reference to FIGS. 4 and 5. FIG. 5 is a flowchart showing the flow of detection of occurrence of jam according to the embodiment of the present disclosure.

START in FIG. 5 is a time when print data is received from the computer 200, the main control portion 7 gives a printing instruction to the engine control portion 8, and the engine control portion 8 starts control of printing.

It should be noted that when a printing job of printing a plurality of pages or a plurality of printing jobs is continuously executed, a plurality of paper sheets P may be conveyed within the printer 100. In other words, the sheet feed portion 2 may continuously feed the paper sheets P at a certain sheet interval, and the conveying portion 3 within the printer 100 may covey a plurality of the paper sheets P. In such continuous printing, detection of occurrence of jam shown in the flowchart of FIG. 5 is executed on each paper sheet P. In other words, in continuous printing, a process of the flowchart of FIG. 5 is executed in parallel on each paper sheet P.

First, the engine control portion 8 causes the sheet feed portion 2 to start sheet feeding (step #1). Then, the engine control portion 8 causes a portion which conveys the paper sheet P (the print engine portion 9) to convey the paper sheet P (step #2). In other words, the engine control portion 8 rotates motors required to convey the paper sheet P, of the respective motors included in the print engine portion 9 (the sheet feed motor 2*m*, the first conveyance motor 3*am*, the main motor 4*m*, the intermediate transfer motor 5*m*, the fixing motor 6*m*, the second conveyance motor 3*bm*, and the double-sided conveyance motor 3*cm*).

Then, the engine control portion 8 confirms the output of each paper sheet sensor S and confirms whether the paper sheet P that is fed and is being conveyed has been jammed (step #3). The confirmation and detection as to whether jam has occurred is performed every predetermined cycle such as every several ten milliseconds.

When the engine control portion 8 has not detected occurrence of jam (No in step #3), the engine control portion 8 confirms whether the paper sheet P has been discharged to the discharge tray 35, on the basis of the output of the sixth paper sheet sensor S6 (step #4). In other words, the engine control portion 8 confirms whether a need to detect occurrence of jam has been eliminated for the target paper sheet P.

When the paper sheet P has been discharged to the discharge tray 35 (Yes in step #4), this flow ends. On the other hand, when the paper sheet P has not been discharged to the discharge tray 35 (No in step #4), the flow returns to step #2.

In addition, when the engine control portion 8 has detected occurrence of jam (Yes in step #3), the engine control portion 8 stops a printing operation such as conveyance of the paper sheet P (step #5). Specifically, the engine control portion 8 stops each motor to stop the conveyance of the paper sheet P, and controls the image forming portion 4 to stop toner image formation. In addition, the engine control portion 8 stops voltage application to the image forming portion 4, the intermediate transfer portion 5, and the secondary transfer roller 57 to stop current application to the heater 61.

Furthermore, the engine control portion 8 obtains the positions of the leading end and the rear end of the paper sheet P the conveyance of which has been stopped due to the occurrence of jam (step #6). When a plurality of paper sheets P are being conveyed, the engine control portion 8 recognizes the positions of the leading end and the rear end of each paper sheet P.

Then, the engine control portion 8 confirms whether the paper sheet P is caught by the fixing portion 6, on the basis of the position of the fixing portion 6, the positions of the leading end and the rear end of the paper sheet P, and the paper sheet size (step #7). In other words, when the engine control portion 8 stops the conveyance of the paper sheet P due to jam stop, the engine control portion 8 determines whether there is the paper sheet P nipped at the fixing nip portion N1 (a fixing stop paper sheet P0).

The engine control portion 8 recognizes the positions of the leading end and the rear end of the paper sheet P. In addition, the position of the fixing nip portion N1 is determined. Specifically, the distance from the registration roller pair 32 to the fixing nip portion N1 and the distance from the third paper sheet sensor S3 to the fixing nip portion N1 are determined. Thus, when the engine control portion 8 detects jam and stops the conveyance of the paper sheet P, the engine control portion 8 can determine whether the paper sheet P is caught by the fixing portion 6, on the basis of whether there is the fixing nip portion N1 between the positions of the leading end and the rear end of the paper sheet P.

If there is no fixing stop paper sheet P0 (No in step #7), the engine control portion 8 causes the display portion 12 of the operation panel 1 to display the occurrence of jam (step #8). At that time, the engine control portion 8 may cause the display portion 12 to display a location at which the jam is determined as having occurred. In other words, the engine control portion 8 may cause the display portion 12 to display a location at which there is the possibility that the jam has occurred. In addition, the engine control portion 8 may confirm the output of each paper sheet sensor S in a state where the conveyance of the paper sheet P is stopped, and may cause the display portion 12 to also display a location at which the paper sheet P remains (a location at which the paper sheet P is present). Then, the flow shifts to a jam handling operation by a user.

Next, the jam handling operation by the user will be described.

When jam has occurred, it is necessary to remove the paper sheet P remaining on a sheet conveyance path in the paper sheet conveying portion 3. In order to allow removal of the paper sheet P, a front cover C1 (shown by a dashed line in FIG. 1) or a side cover C2 provided on the right side surface of the printer 100 can be opened in the printer 100 according to the present embodiment. The sheet conveyance path in the paper sheet conveying portion 3 within the printer 100 can be exposed by opening the front cover C1 or the side cover C2. In addition, the cassette 21 of the sheet feed portion 2 is detachable. Thus, when the paper sheet P is jammed near the sheet feed portion 2, the cassette 21 can be detached, and the jammed paper sheet P can be removed.

As shown in FIG. 4, in order to detect opening/closing of the front cover C1, a front cover sensor S8 (see FIG. 4) is provided. The engine control portion 8 can detect opening/closing of the front cover C1 on the basis of output of the front cover sensor S8. In addition, in order to detect opening/closing of the side cover C2, a side cover sensor S9 (see FIG. 4) is provided. The engine control portion 8 can detect opening/closing of the side cover C2 on the basis of output of the side cover sensor S9. Moreover, in order to detect whether the cassette 21 is mounted, a cassette sensor S10 (see FIG. 4) is provided. The engine control portion 8 can detect detaching or mounting of the cassette 21 on the basis of output of the cassette sensor S10.

The engine control portion 8 detects that each cover is opened or the cassette 21 is detached after jam has been detected, on the basis of the outputs of these sensors. Then, after the engine control portion 8 recognizes that each cover is closed, the cassette 21 is mounted, each paper sheet sensor S detects "no paper sheet", and all paper sheets P remaining on the sheet conveyance path as a result of stop due to occurrence of jam are removed, the engine control portion 8 causes the print engine portion 9 to perform printing from a page that has not been discharged to the discharge tray 35 due to the jam, thereby causing the print engine portion 9 to restart printing.

(Conveyance at the Fixing Portion 6 at Occurrence of Jam)

Figure 6:
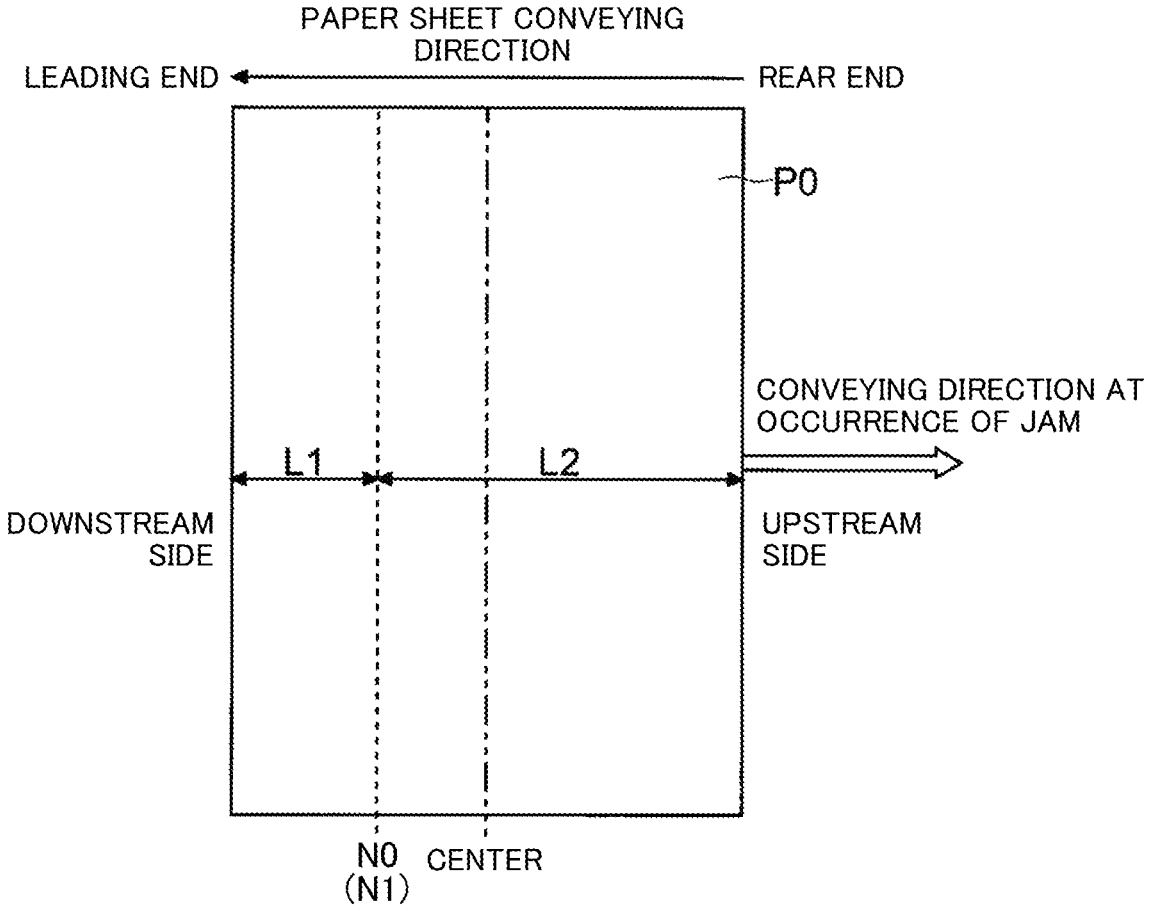
FIG. 6 is a diagram showing a conveyance process at a fixing portion at occurrence of jam according to the first embodiment of the present disclosure.
Figure 7:
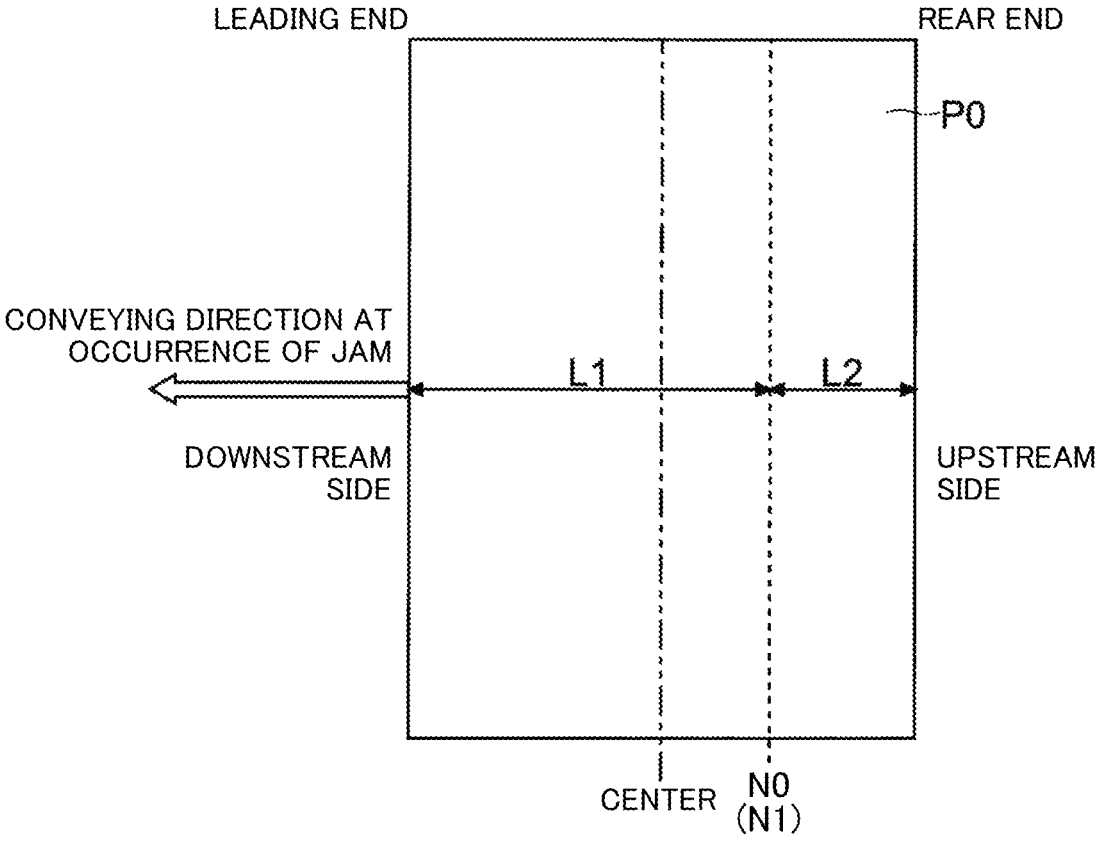
FIG. 7 is a diagram for explaining the conveyance process at the fixing portion at occurrence of jam according to the first embodiment of the present disclosure.
Figure 8:
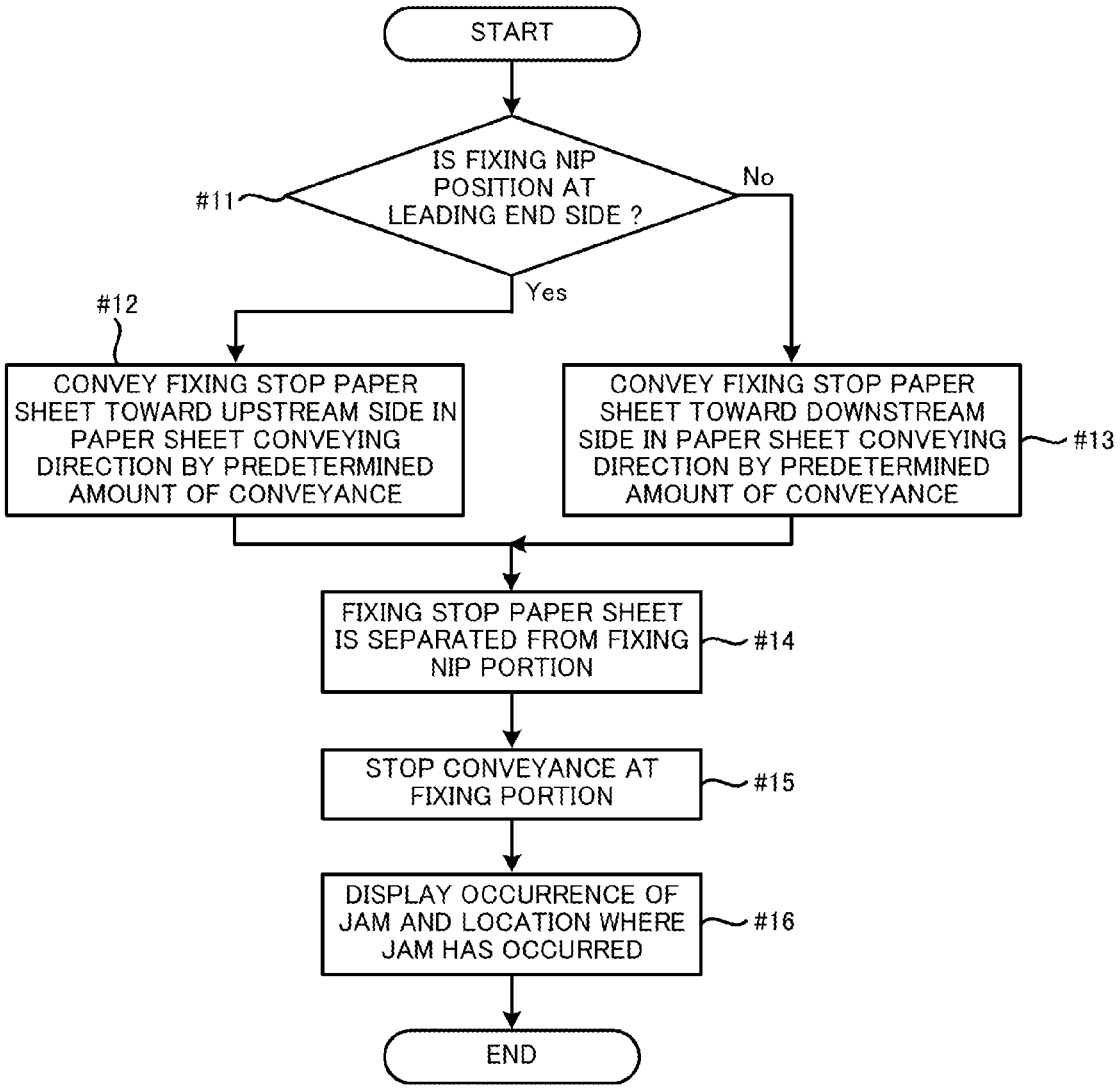
FIG. 8 is a flowchart for explaining the conveyance process at the fixing portion at occurrence of jam according to the first embodiment of the present disclosure.

Next, conveyance of the paper sheet P at the fixing portion 6 at occurrence of jam in the printer 100 according to the first embodiment will be described with reference to FIGS. 6 to 8. FIG. 6 is a diagram showing a conveyance process of the paper sheet P at the fixing portion 6 at occurrence of jam according to the first embodiment. FIG. 7 is a diagram for explaining the conveyance process of the paper sheet P at the fixing portion 6 at occurrence of jam according to the first embodiment. FIG. 8 is a flowchart for explaining the conveyance process of the paper sheet P at the fixing portion 6 at occurrence of jam according to the first embodiment.

As described above, in the printer 100 according to the present embodiment, the engine control portion 8 detects occurrence of jam. When jam has occurred, the engine control portion 8 causes the print engine portion 9 to stop conveyance of the paper sheet P and toner image formation.

However, when the conveyance of the paper sheet P is stopped in a state where the paper sheet P contacts with (is caught by) the fixing nip portion N1 (the nip of the heating roller 62 and the pressure roller 63), various problems may arise as follows: it is difficult to remove the paper sheet P caught by the fixing nip portion N1; when an attempt is made to forcibly remove the paper sheet P caught by the fixing nip portion N1, a component of the fixing portion 6 is broken; when the paper sheet P caught by the fixing nip portion N1 is removed, the paper sheet P is torn and a part of the paper sheet P cannot be removed; the quality of an image is reduced.

Thus, in the printer 100 according to the present embodiment, at jam stop in which conveyance of the paper sheet P is stopped due to occurrence of jam, if the paper sheet P is caught by the fixing nip portion N1, the engine control portion 8 rotates the fixing motor **6*m* to rotate the heating roller 62 and the pressure roller 63**, thereby conveying the paper sheet P such that the paper sheet P is separated from the fixing nip portion N1.

At that time, in the printer 100 according to the present embodiment, the paper sheet P (fixing stop paper sheet P0) caught by the fixing nip portion N1 at the jam stop is conveyed so as to not collide against another paper sheet P that has been stopped, as much as possible. In addition, even when the paper sheet P collides against the other paper sheet P, the degree of the collision is reduced as much as possible.

The conveyance at the fixing portion 6 at occurrence of jam will be described with reference to FIG. 8. START in FIG. 8 is a time when, due to occurrence of jam, the engine control portion 8 stops conveyance of the paper sheet P and the paper sheet P is caught by the fixing nip portion N1. At the jam stop, if the fixing nip portion N1 is between sheets, the process in FIG. 8 is unnecessary, and the engine control portion 8 does not cause the conveyance of the paper sheet P at the fixing portion 6 at occurrence of jam to be performed.

First, the engine control portion 8 confirms whether a fixing nip position N0 is located at the leading end side of a position, on the fixing stop paper sheet P0, corresponding to ½ of the length thereof in the paper sheet conveying direction (step #11).

First, the fixing nip position N0 is previously determined. The fixing nip position N0 is determined within a range where the heating roller 62 and the pressure roller 63 are pressed against each other to perform nipping. In the printer 100 according to the present embodiment, the fixing nip position N0 is set as a position at which a line connecting the center of a rotation shaft of the heating roller 62 and the center of a rotation shaft of the pressure roller 63 intersects a portion at which the heating roller 62 and the pressure roller 63 contact with each other. Alternatively, the fixing nip position N0 may be set as the position of the center of the width in the paper sheet conveying direction of a portion nipped by the heating roller 62 and the pressure roller 63.

The positions of the heating roller 62 and the pressure roller 63 are fixed, and thus the fixing nip position N0 is also fixed. Data indicating the fixing nip position N0 is stored in the engine memory 82.

The engine control portion 8 recognizes the positions of the leading end and the rear end of each paper sheet P at jam stop. In addition, the fixing nip position NO is also previously determined. If the distance between the position of the leading end of the fixing stop paper sheet P0 and the fixing nip position N0 is shorter than ½ of the size in the paper sheet conveying direction of the fixing stop paper sheet P0, the engine control portion 8 determines that the fixing nip position NO is located at the leading end side of the position, on the fixing stop paper sheet P0, corresponding to ½ of the length thereof in the conveying direction. On the other hand, if the distance between the position of the leading end of the fixing stop paper sheet P0 and the fixing nip position N0 is longer than ½ of the size in the paper sheet conveying direction of the fixing stop paper sheet P0, the engine control portion 8 determines that the fixing nip position N0 is located at the rear end side of the position, on the fixing stop paper sheet P0, corresponding to ½ of the length thereof in the conveying direction.

FIGS. 6 and 7 show states of the fixing stop paper sheet P0 when conveyance of the paper sheet P is stopped due to occurrence of jam. Specifically, in FIGS. 6 and 7, the fixing stop paper sheet P0 is shown by a solid line, the fixing nip position N0 is shown by a dashed line, and the center of the fixing stop paper sheet P0 in the conveying direction is shown by an alternate long and two short dashed line.

Specifically, FIG. 6 shows the case where the fixing nip position N0 is located at the leading end side half of the fixing stop paper sheet P0 in the paper sheet conveying direction. In this case, the distance L1 between the fixing nip position N0 and the leading end of the fixing stop paper sheet P0 is shorter than the distance L2 between the fixing nip position N0 and the rear end of the fixing stop paper sheet P0. Thus, regarding a distance of conveyance required to separate the fixing stop paper sheet P0 from the fixing nip portion N1, a distance by which the fixing stop paper sheet P0 is conveyed toward the upstream side in the paper sheet conveying direction is shorter than a distance by which the fixing stop paper sheet P0 is conveyed toward the downstream side in the paper sheet conveying direction.

Therefore, when the fixing nip position N0 is located at the leading end side of the position, on the fixing stop paper sheet P0, corresponding to ½ of the length thereof in the paper sheet conveying direction (Yes in step #11), the engine control portion 8 rotates the fixing motor **6*m* in the reverse direction to convey the fixing stop paper sheet P0 toward the upstream side in the paper sheet conveying direction by an amount of conveyance which allows the fixing stop paper sheet P0 to be removed from the fixing nip portion N1 (step #12**).

Meanwhile, FIG. 7 shows the case where the fixing nip position N0 is located at the rear end side half of the fixing stop paper sheet P0 in the paper sheet conveying direction. In this case, the distance L1 between the fixing nip position NO and the leading end of the paper sheet P is longer than the distance L2 between the fixing nip position N0 and the rear end of the paper sheet P. Thus, regarding a distance of conveyance required to separate the fixing stop paper sheet P0 from the fixing nip portion N1, a distance by which the fixing stop paper sheet P0 is conveyed toward the downstream side in the paper sheet conveying direction is shorter than a distance by which the fixing stop paper sheet P0 is conveyed toward the upstream side in the paper sheet conveying direction.

Therefore, when the fixing nip position N0 is not located at the leading end side of the position, on the fixing stop paper sheet P0, corresponding to ½ of the length thereof in the paper sheet conveying direction (No in step #11), the engine control portion 8 rotates the fixing motor 6*m* in the forward direction to convey the fixing stop paper sheet P0 toward the downstream side in the paper sheet conveying direction by an amount of conveyance which allows the fixing stop paper sheet P0 to be removed from the fixing nip portion N1 (step #13).

As a result of steps #12 and #13, the fixing stop paper sheet P0 is separated from the fixing nip portion N1 (step #14). Thereafter, the engine control portion 8 stops the rotation of the fixing motor 6*m* (step #15). Then, the engine control portion 8 causes the display portion 12 of the operation panel 1 to display the occurrence of jam (step #16). At that time, the engine control portion 8 may cause the display portion 12 to display a location at which the jam is determined as having occurred. Then, the conveyance process at the fixing portion 6 at the occurrence of jam is completed.

As described above, the engine control portion 8 of the printer 100 according to the present embodiment determines the fixing nip position N0 which is the position of the fixing nip portion N1 on the fixing stop paper sheet P0 which is the paper sheet P nipped at the fixing nip portion N1 at the jam stop, on the basis of the outputs of the first to sixth paper sheet sensors S1 to S6. When the fixing nip position N0 is located at the leading end side half of the fixing stop paper sheet P0 in the paper sheet conveying direction, the engine control portion 8 rotates the fixing motor 6*m* in the reverse direction to convey the fixing stop paper sheet P0 toward the upstream side in the paper sheet conveying direction such that the fixing stop paper sheet P0 is separated from the fixing nip portion N1. When the fixing nip position N0 is located at the rear end side half of the fixing stop paper sheet P0 in the paper sheet conveying direction, the engine control portion 8 rotates the fixing motor 6*m* in the forward direction to convey the fixing stop paper sheet P0 toward the downstream side in the paper sheet conveying direction such that the fixing stop paper sheet P0 is separated from the fixing nip portion N1.

Thus, it is possible to rotate each rotator of the fixing portion 6 in the direction in which the distance by which the paper sheet P is conveyed so as to be separated (removed) from the fixing nip portion N1 is shorter. Since the distance of conveyance to separate the paper sheet P from the fixing nip portion N1 is shortened as much as possible, it is possible to avoid collision of the fixing stop paper sheet P0 against the paper sheet P at the upstream side of the fixing stop paper sheet P0 (behind) or at the downstream side of the fixing stop paper sheet P0 (ahead) even when the fixing stop paper sheet P0 is conveyed so as to be separated from the fixing nip portion N1. Or, even when the fixing stop paper sheet P0 collides against the paper sheet P, it is possible to reduce, as much as possible, an amount of conveyance beyond the rear end of the paper sheet P at the downstream side or an amount of conveyance beyond the leading end of the paper sheet P at the upstream side. Therefore, at stop due to occurrence of jam, even when the paper sheet P is conveyed so as to be separated from the fixing nip portion N1, an adverse effect does not occur which makes it difficult to remove the paper sheet P from the sheet conveyance path.

In addition, when conveyance of the paper sheet P is stopped due to occurrence of jam, a state is automatically provided in which no paper sheet P is caught between the rotators of the fixing portion 6. Thus, in handling the jam, the user is allowed to easily remove the paper sheet P remaining on the sheet conveyance path. Moreover, breakage of a component of the fixing portion 6 which is caused by forcibly pulling out the paper sheet P caught between the rotators of the fixing portion 6 in order to remove the paper sheet P does not occur. Furthermore, a reduction in image quality such as offset does not occur.

In addition, the engine control portion 8 of the printer 100 according to the present embodiment causes the notification portion to give notice of occurrence of jam after conveying the fixing stop paper sheet P0 such that the fixing stop paper sheet P0 is separated from the fixing nip portion N1. Thus, when conveyance of the paper sheet P is stopped due to jam, it is possible to start handling the jam in a state where there is no paper sheet P at the fixing nip portion N1.

Second Embodiment

Figure 9A:
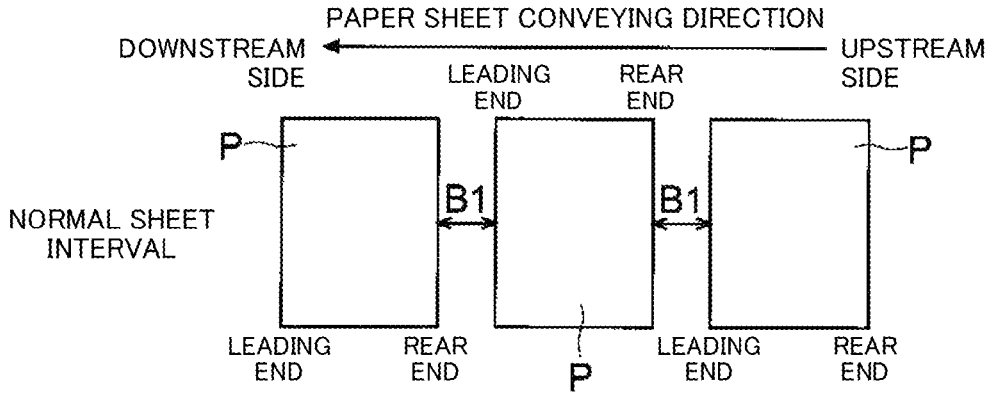
FIGS. 9A to 9C are diagrams for explaining a conveyance process at a fixing portion at occurrence of jam according to a second embodiment of the present disclosure.
Figure 9B:
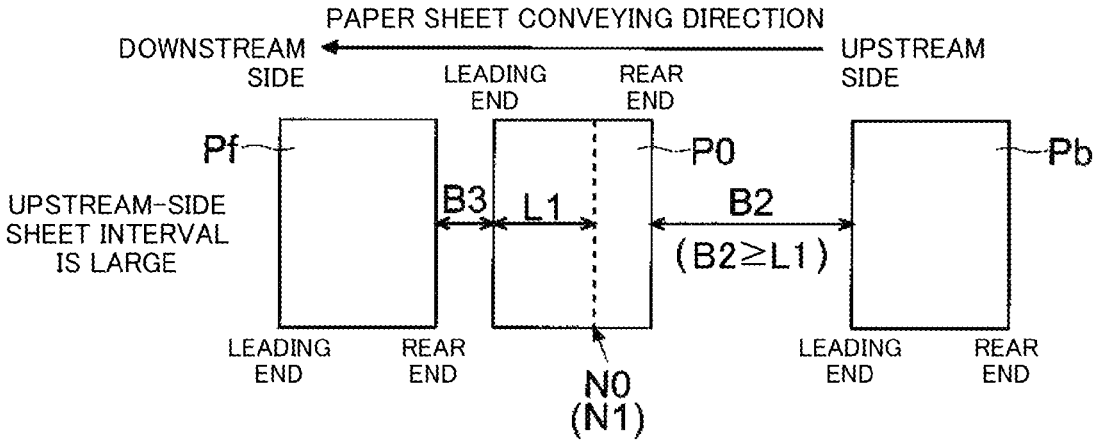
Figure 9C:
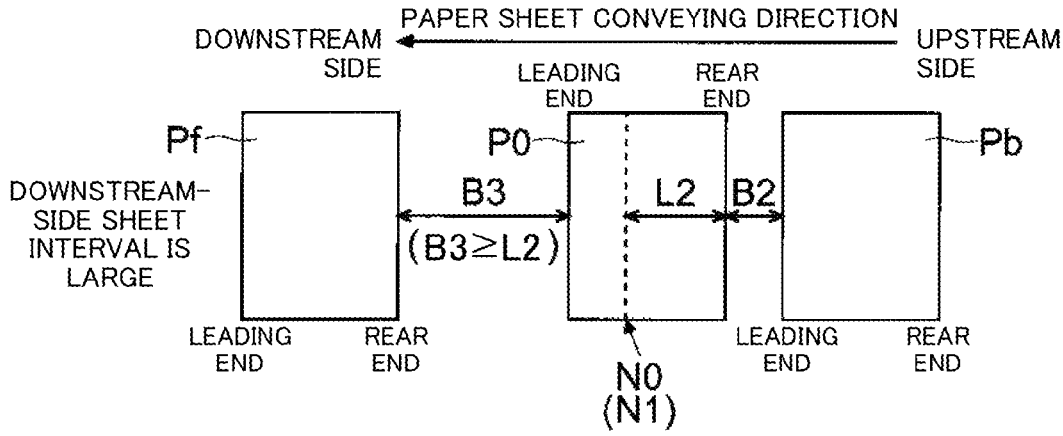
Figure 10:
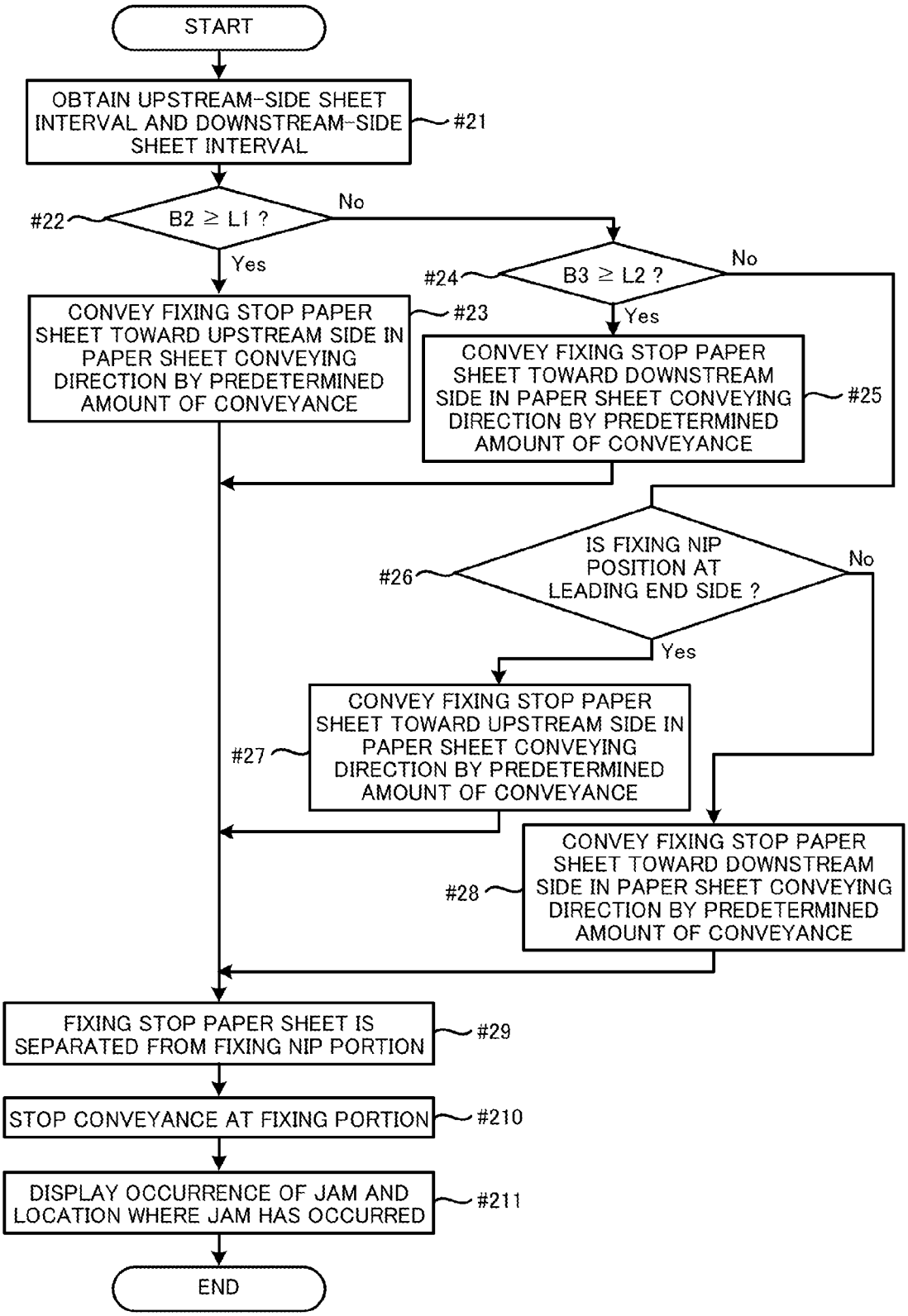
FIG. 10 is a flowchart showing the conveyance process at the fixing portion at occurrence of jam according to the second embodiment of the present disclosure.

Next, a second embodiment will be described with reference to FIGS. 9A to 9C and 10. FIGS. 9A to 9C are diagrams for explaining a conveyance process at the fixing portion 6 at occurrence of jam according to the second embodiment. FIG. 10 is a flowchart showing the conveyance process at the fixing portion 6 at occurrence of jam according to the second embodiment.

The second embodiment is different from the first embodiment in a method of conveying the fixing stop paper sheet P0 at occurrence of jam. However, in the second embodiment, points other than the method of conveying the fixing stop paper sheet P0 at occurrence of jam, such as the configuration of the printer 100, recognition of the leading end and the rear end of the paper sheet P, detection of occurrence of jam, may be the same as those of the first embodiment, and the description in the first embodiment can be employed. Thus, in the second embodiment, only the difference from the first embodiment will be described, and the description and illustration of the common portions are omitted except in the case where a description is particularly given.

In the first embodiment, in accordance with the distance from the leading end of the paper sheet P or the rear end of the paper sheet P to the fixing nip position N0, the fixing stop paper sheet P0 is conveyed toward the upstream side or the downstream side in the paper sheet conveying direction such that the fixing stop paper sheet P0 is separated from the fixing nip portion N1.

The second embodiment is different from the first embodiment in that a direction in which the fixing stop paper sheet P0 is to be conveyed is determined in consideration of the interval between the fixing stop paper sheet P0 and the paper sheet P ahead of the fixing stop paper sheet P0 and the interval between the fixing stop paper sheet P0 and the paper sheet P behind the fixing stop paper sheet P0.

First, the intervals between the paper sheets P will be described with reference to FIGS. 9A to 9C.

In continuous printing in which a plurality of paper sheets P are continuously printed, the engine control portion 8 cause feeding and conveyance of the paper sheets P to be performed at a constant sheet interval (a predetermined sheet interval). Thus, in continuous printing, the engine control portion 8 causes the sheet feed roller 22 and the registration roller pair 32 to start feeding the paper sheet P when the interval from a preceding paper sheet P reaches the predetermined sheet interval (when a predetermined time has elapsed).

FIG. 9A shows a state where the paper sheets P are conveyed at a normal sheet interval in continuous printing. FIG. 9A shows a state where the sheet interval between each paper sheet P is a predetermined sheet interval B1 on specification and the paper sheets P are ideally conveyed.

However, in actual printing, the sheet interval may deviate from the predetermined sheet interval B1. For example, when a slip has occurred at the sheet feed roller 22, the registration roller pair 32, or the like, sheet feeding and conveyance are delayed, and the sheet interval between the paper sheet P that has been slipped and the paper sheet P ahead of this paper sheet P is increased.

In addition, in the printer 100 according to the present embodiment, in order to maintain the quality of an image, the engine control portion 8 may cause the image forming portion 4 and the intermediate transfer portion 5 to perform processing for maintaining the quality of an image, even during continuous printing.

In the printer 100 according to the present embodiment, even during execution of a printing job (during continuous printing), the engine control portion 8 may stop formation of a toner image and refresh the toner used in the developing device. The refresh process is a process of once collecting all the toner from a developing roller 44*a* (see FIG. 2) which carries the toner within the developing device; and forming a thin toner layer on the developing roller 44*a* again. The refresh process is performed each time a given number of sheets are printed or when a number of sheets continuously printed exceeds a predetermined value.

Alternatively, even during execution of a printing job, a process of adjusting deviation of a density or a primary transfer position of a toner image on the intermediate transfer belt 52 may be performed each time a given number of sheets are printed or when the number of sheets continuously printed exceeds a predetermined value. In this case, the engine control portion 8 causes the image forming portion 4 to form a test image and transfer the test image onto the intermediate transfer belt 52, reads the test image with a density sensor (not shown), and performs the process of adjusting deviation of a density or a primary transfer position.

In these image quality maintaining processes during continuous printing, formation of a toner image to be transferred onto the paper sheet P is stopped. Thus, the engine control portion 8 causes conveyance of the paper sheet P from the sheet feed roller 22 or the registration roller pair 32 to stand by. As described above, in the printer 100 according to the present embodiment, the sheet interval may be intentionally made larger than the predetermined sheet interval B1.

FIG. 9B shows a state where the upstream-side sheet interval B2 between the fixing stop paper sheet P0 and the paper sheet P behind the fixing stop paper sheet P0 (an upstream-side paper sheet Pb) is larger than the predetermined sheet interval B1. It should be noted that in FIGS. 9B and 9C, of three paper sheets P, the middle paper sheet P represents the fixing stop paper sheet P0. In addition, in FIGS. 9B and 9C, the fixing nip position N0 is shown by a dashed line.

As shown in FIG. 9B, if the upstream-side sheet interval B2 is equal to or larger than the distance L1 from the leading end of the fixing stop paper sheet P0 to the fixing nip position N0 (B2≥L1), even when the fixing stop paper sheet P0 is conveyed toward the upstream side in the paper sheet conveying direction until the fixing stop paper sheet P0 is removed from the fixing nip portion N1, the paper sheets do not collide against each other. In addition, even when the fixing nip position N0 is located at the leading end side half or the rear end side half of the fixing stop paper sheet P0 in the paper sheet conveying direction, the paper sheets do not collide against each other.

FIG. 9C shows a state where the downstream-side sheet interval B3 between the fixing stop paper sheet P0 and the paper sheet P ahead of the fixing stop paper sheet P0 (a downstream-side paper sheet Pf) is larger than the predetermined sheet interval B1. As shown in FIG. 9C, if the downstream-side sheet interval B3 is equal to or larger than the distance L2 between the fixing nip position N0 and the rear end of the fixing stop paper sheet P0 (B3≥L2), even when the fixing stop paper sheet P0 is conveyed toward the downstream side in the paper sheet conveying direction until the fixing stop paper sheet P0 is removed from the fixing nip portion N1, the paper sheets do not collide against each other. In addition, even when the fixing nip position N0 is located at the leading end side half or the rear end side half of the fixing stop paper sheet P0 in the paper sheet conveying direction, the paper sheets do not collide against each other.

Thus, in the printer 100 according to the present embodiment, a direction in which the fixing stop paper sheet P0 is to be conveyed at jam stop is determined in consideration of the sheet intervals between the fixing stop paper sheet P0 and the paper sheets P in front of and in rear of the fixing stop paper sheet P0.

Next, the conveyance at the fixing portion 6 at occurrence of jam in the second embodiment will be described with reference to FIG. 10. START in FIG. 10 is a time when, due to occurrence of jam, the engine control portion 8 stops conveyance of the paper sheet P and the paper sheet P is caught by the fixing nip portion N1.

First, the engine control portion 8 obtains the upstream-side sheet interval B2 and the downstream-side sheet interval B3 (step #21). Specifically, the engine control portion 8 obtains the upstream-side sheet interval B2 which is the sheet interval (distance) from the position of the rear end of the fixing stop paper sheet P0 to the position of the leading end of the upstream-side paper sheet Pb. In addition, the engine control portion 8 obtains the downstream-side sheet interval B3 which is the sheet interval (distance) from the position of the leading end of the fixing stop paper sheet P0 to the position of the rear end of the downstream-side paper sheet Pf.

Next, the engine control portion 8 confirms whether the upstream-side sheet interval B2 is equal to or larger than the distance L1 from the leading end of the fixing stop paper sheet P0 to the fixing nip position N0 (step #22). If the upstream-side sheet interval B2 is equal to or larger than the distance L1 from the leading end of the fixing stop paper sheet P0 to the fixing nip position N0 (Yes in step #22), the engine control portion 8 rotates the fixing motor 6*m* in the reverse direction to convey the fixing stop paper sheet P0 toward the upstream side in the paper sheet conveying direction by an amount which allows the fixing stop paper sheet P0 to be removed from the fixing nip portion N1 (step #23).

On the other hand, if the upstream-side sheet interval B2 is less than the distance L1 from the leading end of the fixing stop paper sheet P0 to the fixing nip position N0 (No in step #22), the engine control portion 8 confirms whether the downstream-side sheet interval B3 is equal to or larger than the distance L2 from the rear end of the fixing stop paper sheet P0 to the fixing nip position N0 (step #24). If the downstream-side sheet interval B3 is equal to or larger than the distance L2 from the rear end of the fixing stop paper sheet P0 to the fixing nip position N0 (Yes in step #24), the engine control portion 8 rotates the fixing motor 6*m* in the forward direction to convey the fixing stop paper sheet P0 toward the downstream side in the paper sheet conveying direction by an amount which allows the fixing stop paper sheet P0 to be removed from the fixing nip portion N1 (step #25).

If the downstream-side sheet interval B3 is less than the distance L2 from the rear end of the fixing stop paper sheet P0 to the fixing nip position N0 (No in step #24), the conveyance at the fixing portion 6 at occurrence of jam as described in the first embodiment is performed. Steps #26 to #28 in the present embodiment are the same as steps #11 to #13 in the first embodiment (FIG. 8), thus the description thereof is omitted, and the description in the first embodiment is employed.

As a result of steps #23, #25, #27, and #28, the fixing stop paper sheet P0 is separated from the fixing nip portion N1 (step #29). Thereafter, the engine control portion 8 stops the rotation of the fixing motor 6*m* (step #210). In addition, the engine control portion 8 causes the display portion 12 of the operation panel 1 to display the occurrence of jam (step #211). At that time, the engine control portion 8 may cause the display portion 12 to display a location at which the jam is determined as having occurred. Then, the conveyance process at the fixing portion 6 at the occurrence of jam is completed.

Thus, in the printer 100 according to the present embodiment, in addition to the advantageous effects obtained in the first embodiment, it is possible to convey the fixing stop paper sheet P0 in a direction in which the fixing stop paper sheet P0 is assuredly prevented from colliding against another paper sheet P. Therefore, an adverse effect does not occur which makes it difficult to remove the paper sheet P due to collision of the paper sheet P against another paper sheet P.

Next, other embodiments will be described. In the embodiments described above, the direction in which the fixing stop paper sheet P0 is to be conveyed is determined on the basis of whether the fixing nip position N0 is located at the leading end side half of the paper sheet P in the paper sheet conveying direction and the sheet intervals between the fixing stop paper sheet P0 and other paper sheets P. However, when jam has occurred at the upstream side of the fixing portion 6, the fixing stop paper sheet P0 may be conveyed toward the downstream side since there is no or less factors of inhibiting conveyance of the paper sheets P at the downstream side of the fixing portion 6 and fixing can be performed on the fixing stop paper sheet P0.

In this case, the engine control portion 8 determines a location where jam has occurred, on the basis of the output of each paper sheet sensor S. As a result of the determination, if the location where the jam has occurred is at the upstream side of the fixing portion 6, the engine control portion 8 always rotates the fixing motor 6*m* in the forward direction to convey the fixing stop paper sheet P0 toward the downstream side in the paper sheet conveying direction. In this case, only when jam has occurred at the downstream side of the fixing portion 6, the direction in which the fixing stop paper sheet P0 is to be conveyed is determined in accordance with whether the fixing nip position N0 is located at the leading end side half of the fixing stop paper sheet P0 in the paper sheet conveying direction and the sheet intervals from the upstream-side paper sheet Pb and the downstream-side paper sheet Pf.

That is, the engine control portion 8 recognizes the location where the jam has occurred, on the basis of the outputs of the first to sixth paper sheet sensors S1 to S6; and if the location where the jam has occurred is at the downstream side of the fixing portion 6, the engine control portion 8 rotates the fixing motor 6*m* in the forward direction to convey the fixing stop paper sheet P0 toward the upstream side in the paper sheet conveying direction such that the fixing stop paper sheet P0 is separated from the fixing nip portion N1, even in the case where the fixing nip position N0 is located at the leading end side half of the fixing stop paper sheet P0 in the paper sheet conveying direction, in the case where the upstream-side sheet interval B2 is equal to or larger than the distance from the fixing nip position N0 to the leading end of the fixing stop paper sheet P0 at jam stop, or even in both cases.

If the jam has occurred at the upstream side of the fixing portion 6 in the paper sheet conveying direction, even when the fixing stop paper sheet P0 is conveyed toward the downstream side in the paper sheet conveying direction, another paper sheet P does not further come to the location where the jam has occurred. According to this configuration, the jam does not worsen, and it is possible to convey the fixing stop paper sheet P0 to separate the fixing stop paper sheet P0 from the fixing nip portion N1 such that it is not made difficult to remove the paper sheet P from the sheet conveyance path in handling the jam.

The present disclosure is applicable to an image forming apparatus including a fixing device.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a print engine portion configured to perform printing, the print engine portion including:

a conveying portion configured to convey paper sheets within the apparatus;

an image forming portion configured to form a toner image;

a transfer portion configured to transfer the formed toner image onto the paper sheet; and a fixing portion including a heating rotator heated by a heater and a pressure rotator pressed against the heating rotator, the fixing portion being configured to rotate to cause the paper sheets to pass through a fixing nip portion which is a nip between the heating rotator and the pressure rotator, to fix the toner image on the paper sheets;

a plurality of paper sheet detectors provided in the conveying portion; and a control portion configured to control the print engine portion, to detect occurrence of a jam on the basis of outputs of the paper sheet detectors, and to cause the print engine portion to perform a jam stop to stop conveyance of the paper sheets, when detecting occurrence of the jam, wherein the control portion determines a fixing nip position which is a position of the fixing nip portion on a fixing stop paper sheet that is a paper sheet nipped at the fixing nip portion during the jam stop, on the basis of the outputs of the paper sheet detectors, if the fixing nip position is located at a leading end half of the fixing stop paper sheet in a paper sheet conveying direction, the control portion controls the fixing portion to rotate in a reverse direction to convey the fixing stop paper sheet to an upstream side in the paper sheet conveying direction such that the fixing stop paper sheet is separated from the fixing nip portion, and if the fixing nip position is located at a rear end half of the fixing stop paper sheet in the paper sheet conveying direction, the control portion controls the fixing portion to rotate in a forward direction to convey the fixing stop paper sheet toward a downstream side in the paper sheet conveying direction such that the fixing stop paper sheet is separated from the fixing nip portion.

2. The image forming apparatus according to claim 1, wherein the control portion obtains an upstream side sheet interval which is a sheet interval between the fixing stop paper sheet and a paper sheet at an upstream side of the fixing stop paper sheet in the paper sheet conveying direction, on the basis of the outputs of the paper sheet detectors, and if the upstream side sheet interval is equal to or larger than a distance from the fixing nip position to a leading end of the fixing stop paper sheet at the jam stop, even when the fixing nip position is located at the rear end side half of the fixing stop paper sheet in the paper sheet conveying direction, the control portion controls the fixing portion to rotate in the reverse direction to convey the fixing stop paper sheet toward the upstream side in the paper sheet conveying direction such that the fixing stop paper sheet is separated from the fixing nip portion.

3. The image forming apparatus according to claim 1, wherein the control portion obtains a downstream side sheet interval which is a sheet interval between the fixing stop paper sheet and a paper sheet at a downstream side of the fixing stop paper sheet in the paper sheet conveying direction, on the basis of the outputs of the paper sheet detectors, and if the downstream side sheet interval is equal to or larger than a distance from the fixing nip position to a rear end of the fixing stop paper sheet at the jam stop, even when the fixing nip position is located at the leading end half of the fixing stop paper sheet in the paper sheet conveying direction, the control portion controls the fixing portion to rotate in the forward direction to convey the fixing stop paper sheet toward the downstream side in the paper sheet conveying direction such that the fixing stop paper sheet is separated from the fixing nip portion.

4. The image forming apparatus according to claim 2, wherein the control portion recognizes a location where the jam has occurred, on the basis of the outputs of the paper sheet detectors, and if the location where the jam has occurred is at an upstream side of the fixing portion, the control portion controls the fixing portion to rotate in the forward direction to convey the fixing stop paper sheet toward the downstream side in the paper sheet conveying direction such that the fixing stop paper sheet is separated from the fixing nip portion, even in the case where the fixing nip position is located at the leading end half of the fixing stop paper sheet in the paper sheet conveying direction, even in the case where the upstream side sheet interval is equal to or larger than a distance from the fixing nip position to a leading end of the fixing stop paper sheet at the jam stop, or even in both cases.

5. The image forming apparatus according to claim 1, further comprising a notification portion configured to notify a user of a message, wherein the control portion causes the notification portion to give notice of occurrence of the jam after the fixing stop paper sheet is conveyed so as to be separated from the fixing nip portion.

* * * * *